US011320175B2

(12) United States Patent
Matsumoto et al.

(10) Patent No.: US 11,320,175 B2
(45) Date of Patent: May 3, 2022

(54) REFRIGERANT CIRCUIT

(71) Applicant: Mitsubishi Electric Corporation, Chiyoda-ku (JP)

(72) Inventors: Takashi Matsumoto, Chiyoda-ku (JP); Yoji Onaka, Chiyoda-ku (JP); Hiroyuki Okano, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 57 days.

(21) Appl. No.: 15/575,417

(22) PCT Filed: Jun. 17, 2015

(86) PCT No.: PCT/JP2015/067486
§ 371 (c)(1),
(2) Date: Nov. 20, 2017

(87) PCT Pub. No.: WO2016/203581
PCT Pub. Date: Dec. 22, 2016

(65) Prior Publication Data

US 2018/0156498 A1 Jun. 7, 2018

(51) Int. Cl.
*F25B 5/02* (2006.01)
*F25B 49/02* (2006.01)
(Continued)

(52) U.S. Cl.
CPC ..... *F25B 5/02* (2013.01); *F25B 39/02* (2013.01); *F25B 39/028* (2013.01); *F25B 41/42* (2021.01);
(Continued)

(58) Field of Classification Search
CPC .. F25B 5/02; F25B 2400/23; F25B 2400/061; F25B 41/04; F25B 41/043; F25B 39/02;
(Continued)

(56) References Cited

U.S. PATENT DOCUMENTS 5,142,879 A * 9/1992 Nakamura ..... F25B 41/04 62/160
5,156,014 A 10/1992 Nakamura et al.
(Continued)

FOREIGN PATENT DOCUMENTS

EP 0 453 271 A2 10/1991
JP 02-96569 U 8/1990
(Continued)

OTHER PUBLICATIONS

Partial English Machine Translation: WO 2015045452. Accessed Sep. 2019.*
(Continued)

*Primary Examiner* — Tavia Sullens
(74) *Attorney, Agent, or Firm* — Xsensus LLP

(57) ABSTRACT

In a refrigerant circuit of an air conditioning device, an upper heat source side heat exchanger having a large heat load and a lower heat source side heat exchanger having a small heat load are connected in parallel between an expansion device and a suction side of a compressor. Additionally, the refrigerant circuit of the air conditioning device is provided with a branch circuit configured to distribute refrigerant to each of the upper heat source side heat exchanger and the lower heat source side heat exchanger, and the branch circuit is configured to supply the upper heat source side heat exchanger with refrigerant of lower quality than that of the refrigerant supplied to the lower heat source side heat exchanger.

11 Claims, 20 Drawing Sheets

(51) Int. Cl.
*F25B 39/02* (2006.01)
*F25B 41/42* (2021.01)

(52) U.S. Cl.
CPC ..... *F25B 49/02* (2013.01); *F25B 2400/061* (2013.01); *F25B 2400/23* (2013.01); *F25B 2500/18* (2013.01); *F25B 2500/19* (2013.01); *F25B 2700/21151* (2013.01); *F25B 2700/21174* (2013.01); *F25B 2700/21175* (2013.01)

(58) Field of Classification Search
CPC ..... F25B 39/028; F25B 2341/0661; F25B 2500/09; F25B 2500/19; F25B 2600/21; F25B 2600/2515; F25B 2600/25; F25B 2313/0314; F25B 2313/0315; F25B 2313/0233; F25B 2313/02331; F25B 2313/02332; F25B 2313/02333; F25B 2313/02334; F25D 11/022
See application file for complete search history.

(56) References Cited

U.S. PATENT DOCUMENTS 6,318,116 B1 * 11/2001 Gabel ..... B60H 1/323 62/475
2004/0035132 A1 * 2/2004 Park ..... F25B 13/00 62/324.1
2006/0218952 A1 * 10/2006 Nagae ..... F25B 1/10 62/216
2010/0132400 A1 * 6/2010 Sugiura ..... F25B 41/00 62/500

FOREIGN PATENT DOCUMENTS

| | | | | |
|---|---|---|---|---|
| JP | 05-296586 | A | | 11/1993 |
| JP | 09178304 | A | * | 7/1997 |
| JP | 10-19416 | A | | 1/1998 |
| JP | 2005-226972 | A | | 8/2005 |
| JP | 2006-029734 | A | | 2/2006 |
| JP | 2009-085481 | A | | 4/2009 |
| JP | 2009-300001 | A | | 12/2009 |
| JP | 2010249335 | A | * | 11/2010 |
| JP | 2011-247522 | A | | 12/2011 |
| JP | 2013-015289 | A | | 1/2013 |
| JP | 2014-102009 | A | | 6/2014 |
| WO | 2014/199484 | A1 | | 12/2014 |
| WO | 2015/045452 | A1 | | 4/2015 |
| WO | WO-2015045452 | A1 | * | 4/2015 |

OTHER PUBLICATIONS

Extended European Search Report dated Nov. 28, 2018 in European Patent Application No. 15895602.9, citing document AO therein, 7 pages.
International Search Report dated Aug. 25, 2015 in PCT/JP2015/067486 filed Jun. 17, 2015.
European Office Action issued in European Patent Application No. 15895602.9 dated May 12, 2020.

* cited by examiner

REFRIGERANT CIRCUIT

TECHNICAL FIELD

The present invention relates to a refrigerant circuit provided with multiple evaporators, and an air conditioning device provided with such a refrigerant circuit.

BACKGROUND ART

In the related art, there has been proposed a refrigerant circuit in which multiple refrigerant flow channels are formed inside an evaporator, in which a gas-liquid separator and a flow dividing pipe are provided on the upstream side of the evaporator, and that supplies each refrigerant flow channel with refrigerant having a gas-liquid mixture ratio corresponding to the heat exchanging performance (For example, see Patent Literature 1).

CITATION LIST

Patent Literature

Patent Literature 1: Japanese Unexamined Utility Model Application Publication No. 2-96569

SUMMARY OF INVENTION

Technical Problem

A refrigerant circuit connected to multiple evaporators in parallel has been proposed. In such a refrigerant circuit, the heat loads on the respective evaporators may become non-uniform in some cases. In such cases, to moderate the drop in the heat exchanging performance of the evaporators, it is necessary to distribute, to each of the evaporators, refrigerant having a gas-liquid mixture ratio corresponding to the heat load. However, with the technology described in Patent Literature 1, refrigerant having different gas-liquid mixture ratios can be supplied to the respective refrigerant flow channels of a single evaporator, but when multiple evaporators are connected in parallel, refrigerant having a gas-liquid mixture ratio corresponding to the heat load on each evaporator cannot be supplied, and thus causing a problem of a drop in the heat exchanging performance of the evaporators.

The present invention has been devised to address problems like the above, and an objective is to provide a refrigerant circuit capable of distributing refrigerant having a gas-liquid mixture ratio corresponding to the heat load to multiple heat exchangers connected in parallel, and to provide an air conditioning device provided with such a refrigerant circuit.

Solution to Problem

A refrigerant circuit according to one embodiment of the present invention is provided with a compressor, a condenser, an expansion device, and multiple evaporators with different heat loads. The multiple evaporators are connected in parallel between the expansion device and a suction side of the compressor. The multiple evaporators include a first evaporator and a second evaporator having a smaller heat load than does the first evaporator. A branch circuit is provided between the expansion device and the multiple evaporators, and configured to distribute refrigerant to each of the multiple evaporators. The branch circuit supplies the first evaporator with refrigerant of lower quality than quality of refrigerant supplied to the second evaporator.

Advantageous Effects of Invention

A refrigerant circuit according to one embodiment of the present invention is configured to supply, by a branch circuit, refrigerant of lower quality to an evaporator having a large heat load than that of an evaporator having a small heat load. In other words, a refrigerant circuit according to one embodiment of the present invention is configured to cause more liquid-phase refrigerant having a large amount of latent heat to flow into an evaporator having a large heat load than that of an evaporator having a small heat load. For this reason, a refrigerant circuit according to one embodiment of the present is able to divide refrigerant flow corresponding to the heat load with a branch circuit, and thus the heat exchanging performance of the evaporators can be improved compared to the related art.

DESCRIPTION OF EMBODIMENTS

Figure 1:
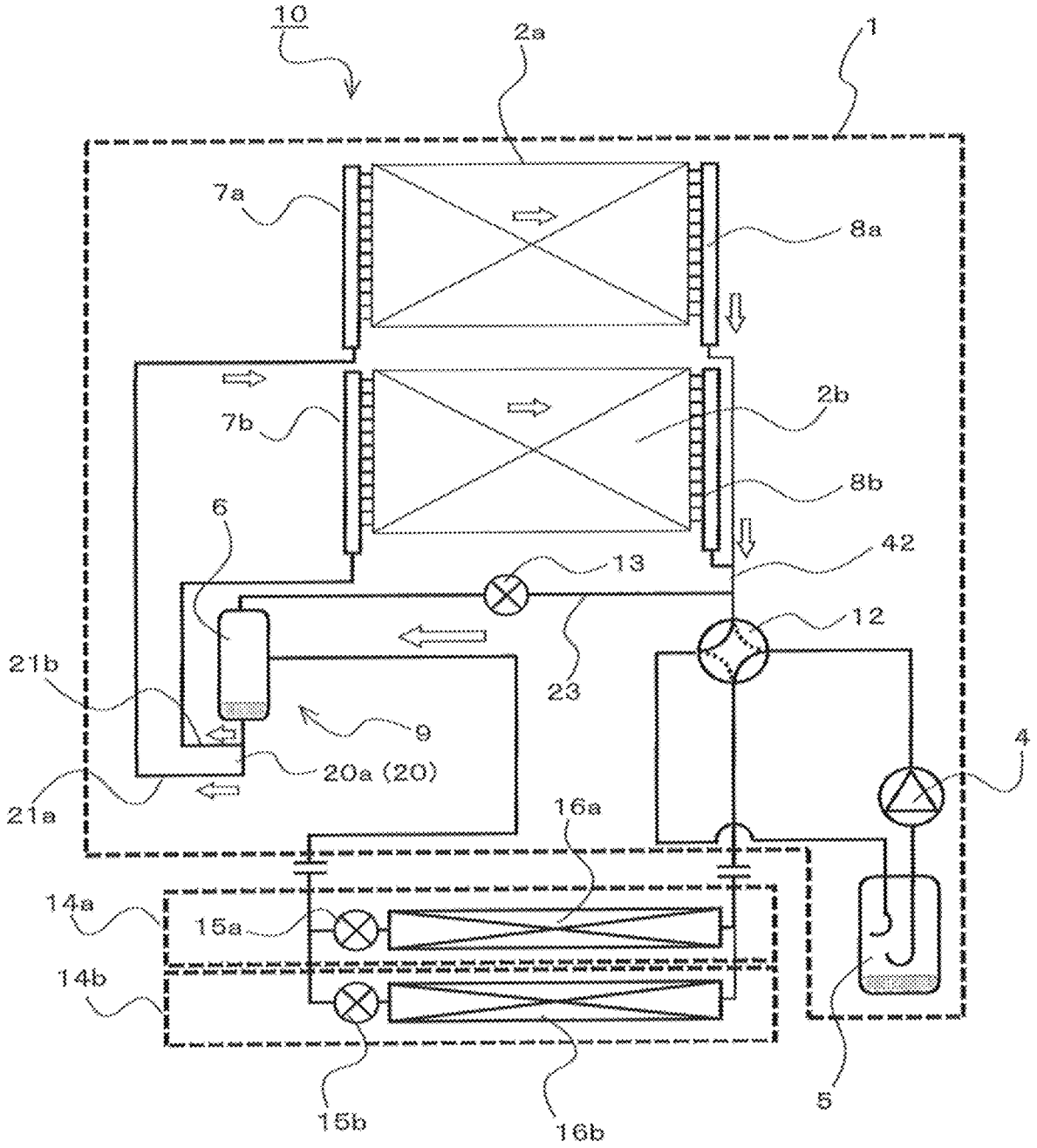
FIG. 1 is a refrigerant circuit diagram illustrating an example of an air conditioning device according to Embodiment 1 of the present invention.

Hereinafter, embodiments of a refrigerant circuit according to the present invention and an air conditioning device according to the present invention provided with such a refrigerant circuit will be described with reference to the drawings. However, the present invention is not limited by the embodiments described below. Also, in the drawings hereinafter, the relative sizes of component members may differ from actual relative sizes in some cases. Also, the terms "vertical direction" and "horizontal direction" in this specification are not to be interpreted strictly, but instead should be interpreted as rough indications of direction.

Embodiment 1

Figure 2:
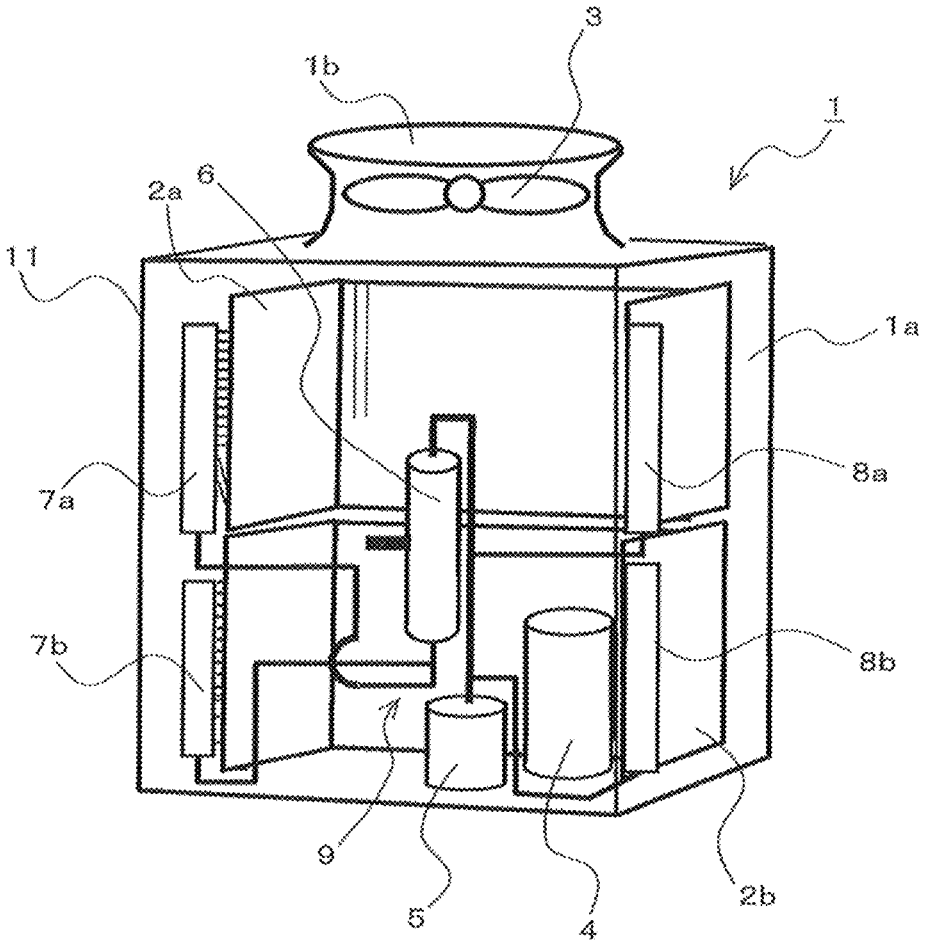
FIG. 2 is a perspective view of the interior of a heat source side unit of the air conditioning device according to Embodiment 1 of the present invention.
Figure 3:
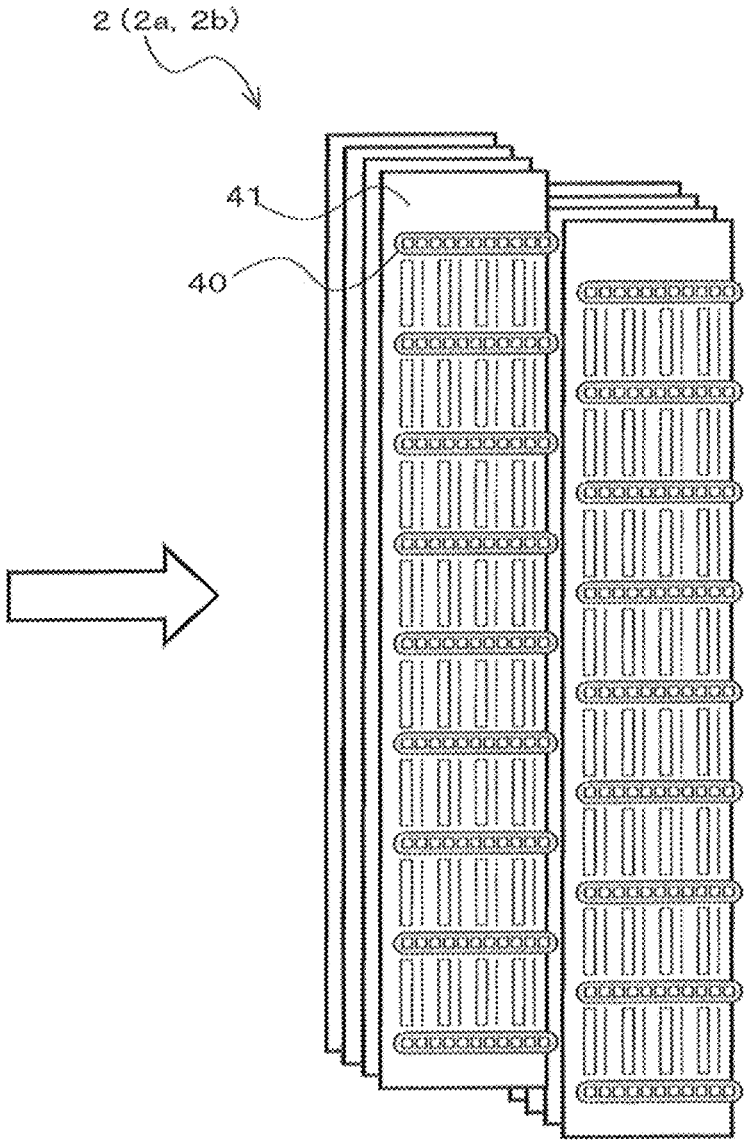
FIG. 3 is a perspective view illustrating an example of a heat source side heat exchanger of the air conditioning device according to Embodiment 1 of the present invention.
Figure 4:
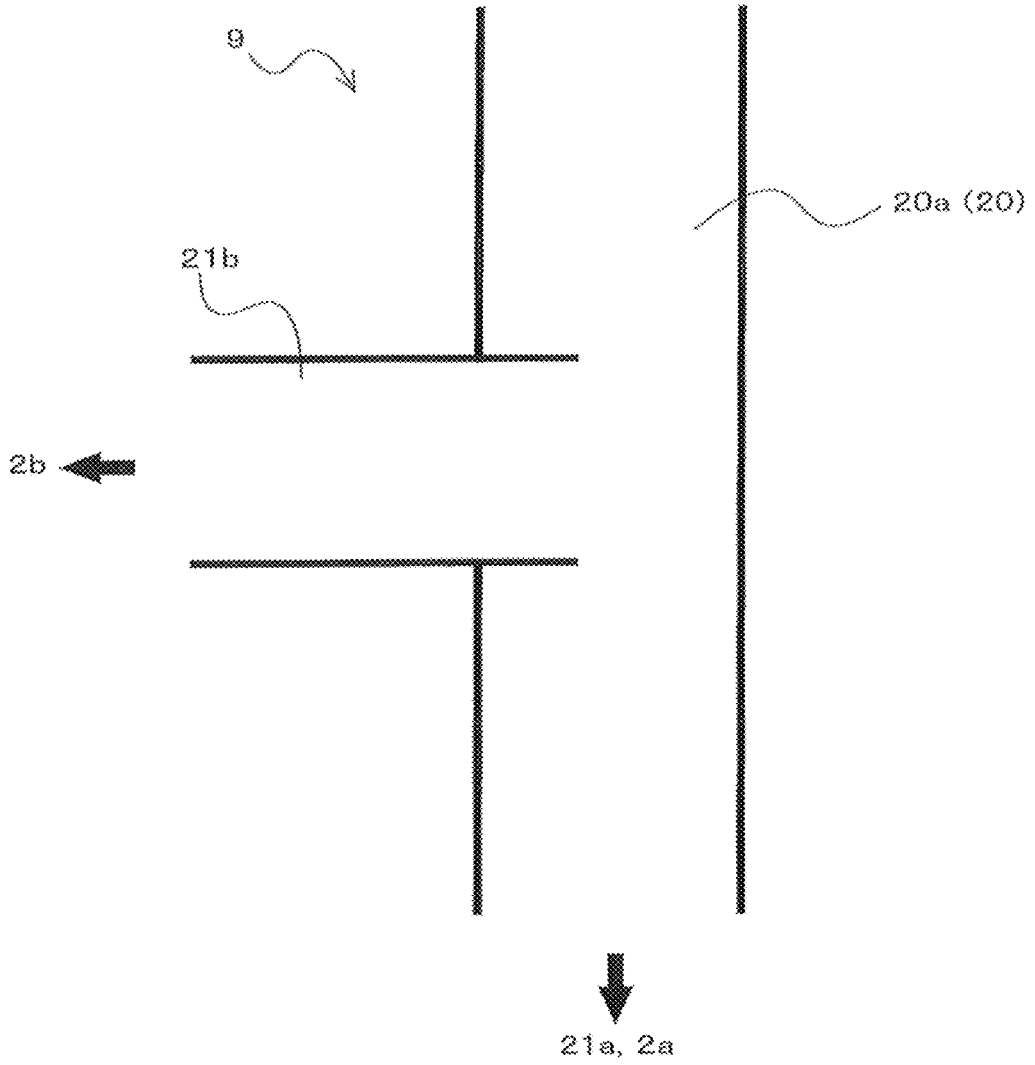
FIG. 4 is an enlarged view (cross-section view) illustrating the principle parts in the vicinity of a vertical pipe part of a branch circuit in the air conditioning device according to Embodiment 1 of the present invention.

FIG. 1 is a refrigerant circuit diagram illustrating an example of an air conditioning device according to Embodiment 1 of the present invention. FIG. 2 is a perspective view of the interior of a heat source side unit of the air conditioning device. FIG. 3 is a perspective view illustrating an example of a heat source side heat exchanger of the air conditioning device. Also, FIG. 4 is an enlarged view (cross-section view) illustrating the principle parts in the vicinity of a vertical pipe part of a branch circuit in the air conditioning device. Note that the solid-white arrows in FIG. 1 indicate the direction of refrigerant flow during heating operation.

The refrigerant circuit of an air conditioning device 10 according to Embodiment 1 has a configuration in which a compressor 4, use side heat exchangers 16 that operate as condensers during heating operation, expansion devices 15, and multiple heat source side heat exchangers 2 that operate as evaporators during heating operation are connected in order by pipes. Also, the multiple heat source side heat exchangers 2 are connected in parallel between the expansion devices 15 and the suction side of the compressor 4. These multiple heat source side heat exchangers 2 have different heat loads, as described later. Note that FIG. 1 illustrates an example in which two heat source side heat exchangers 2 (an upper heat source side heat exchanger 2*a* and a lower heat source side heat exchanger 2*b*) are provided.

Herein, the upper heat source side heat exchanger 2*a* corresponds to a first evaporator of the present invention, while the lower heat source side heat exchanger 2*b* corresponds to a second evaporator of the present invention.

Also, the refrigerant circuit of the air conditioning device 10 according to Embodiment 1 is provided with a branch circuit 9 between the expansion devices 15 and the multiple heat source side heat exchangers 2. During heating operation, the branch circuit 9 distributes refrigerant having a gas-liquid mixture ratio corresponding to the heat load to each of the upper heat source side heat exchanger 2*a* and the lower heat source side heat exchanger 2*b*.

Additionally, to perform both cooling operation and heating operation, the refrigerant circuit of the air conditioning device 10 according to Embodiment 1 is provided with a flow channel switch 12 on the discharge side of the compressor 4. In addition, the refrigerant circuit of the air conditioning device 10 according to Embodiment 1 is also provided with an accumulator 5, on the suction side of the compressor 4, that moderates liquid backflow to the compressor 4.

These components constituting the refrigerant circuit of the air conditioning device 10 are housed in a heat source side unit 1 or use side units 14.

The heat source side unit 1, together with the use side units 14, constitutes a refrigeration cycle that circulates refrigerant. More specifically, during heating operation, the heat source side unit 1 supplies the use side units 14 with heat collected from outdoors. Also, during cooling operation, the heat source side unit 1 discharges, to the outdoors, heat collected by the use side units 14 from indoor rooms or other spaces that are being air-conditioned. The heat source side unit 1 includes a housing 11, and houses the compressor 4, the flow channel switch 12, the upper heat source side heat exchanger 2*a*, the lower heat source side heat exchanger 2*b*, a fan 3, the accumulator 5, and the branch circuit 9 inside the housing 11.

Meanwhile, the use side units 14 are installed in an indoor room or other space to be air-conditioned, and house the use side heat exchangers 16 and the expansion devices 15. Note that the air conditioning device 10 according to Embodiment 1 is provided with two use side units 14 (a first use side unit 14*a* and a second use side unit 14*b*). The first use side unit 14*a* houses a first use side heat exchanger 16*a* and a first expansion device 15*a*. The second use side unit 14*b* houses a second use side heat exchanger 16*b* and a second expansion device 15*b*. The first use side unit 14*a* and the second use side unit 14*b* are connected in parallel.

Note that the number of the use side units 14 is not limited to two, and may also be one, three, or more.

The compressor 4 suctions and compresses refrigerant to a high temperature and high pressure state, and is made up of a scroll compressor, a vane compressor, or other similar compressor, for example. The flow channel switch 12 switches a heating flow channel and a cooling flow channel in response to the switching of the operating mode between cooling operation and heating operation, and is made up of a four-way valve, for example. During heating operation, the flow channel switch 12 connects the discharge side of the compressor 4 to the use side heat exchangers 16, and also connects the heat source side heat exchangers 2 to the suction side of the compressor 4 (or the accumulator 5 in cases in which the accumulator 5 is provided). On the other hand, during cooling operation, the flow channel switch 12 connects the discharge side of the compressor 4 to the heat source side heat exchangers 2, and also connects the use side heat exchangers 16 to the suction side of the compressor 4 (or the accumulator 5 in cases in which the accumulator 5 is provided). Note that although the case of using a four-way valve as the flow channel switch 12 is illustrated as an example, the configuration is not limited to this example, and a combination of multiple two-way valves or other components may also be configured, for example. Additionally, in the case of configuring the air conditioning device 10 as a device dedicated to heating operation, it is not particularly necessary to provide the flow channel switch 12.

The heat source side heat exchangers 2 exchange heat between refrigerant and outdoor air (air from the outdoors), and have a shape bent into a backwards C-shape as viewed from the top of the housing 11 (in other words, a U-shape), for example. As described above, the air conditioning device 10 according to Embodiment 1 includes two heat source side heat exchangers 2 (the upper heat source side heat exchanger 2*a* and the lower heat source side heat exchanger 2*b*). The lower heat source side heat exchanger 2*b* is disposed in the lower part of the housing 11. The upper heat source side heat exchanger 2*a* is disposed in the upper part of the housing 11, or in other words, above the lower heat source side heat exchanger 2*b*. Also, in the housing 11, an air inlet 1*a* is formed on the side face opposite the upper heat source side heat exchanger 2*a* and the lower heat source side heat exchanger 2*b*. The upper heat source side heat exchanger 2*a* and the lower heat source side heat exchanger 2*b* have disconnected heat transfer fins.

Specifically, the heat source side heat exchangers 2 (each of the upper heat source side heat exchanger 2*a* and the lower heat source side heat exchanger 2*b*) are configured as in FIG. 3, for example. The heat source side heat exchangers 2 are provided with multiple heat transfer pipes 40 arranged in the horizontal direction. These heat transfer pipes 40 are arranged in parallel, spaced at a certain interval in the vertical direction. The heat transfer pipes 40 are flat pipes, for example, with multiple refrigerant flow channels formed inside. Also, the heat source side heat exchangers 2 are provided with multiple heat transfer fins 41 into which the multiple heat transfer pipes 40 are inserted. These heat transfer fins 41 are arranged in parallel, spaced at a certain interval (for example, 3 mm) in the axial direction of the heat transfer pipes 40. While the air conditioning device 10 is running, air flows through gaps between the heat transfer fins 41 along the planar surfaces of the heat transfer fins 41, as indicated by the solid-white arrow in FIG. 3. Also, refrigerant flowing through the refrigerant flow channels of the heat transfer pipes 40 flows in the axial direction of the heat transfer pipes 40. With this configuration, the refrigerant and outdoor air exchange heat, thereby transferring waste heat or supplying heat. Note that in Embodiment 1, heat exchange units are configured with multiple heat transfer pipes 40 and multiple heat transfer fins 41, and multiple heat exchange units are arranged in parallel along the direction in which outdoor air passes, thereby configuring the heat source side heat exchangers 2.

Also, as illustrated in FIGS. 1 and 2, the heat source side heat exchangers 2 are provided with confluent pipes 8 and distributors connected to the multiple heat transfer pipes 40. In Embodiment 1, header-type distributors 7 are used.

Specifically, each of the heat transfer pipes 40 of the upper heat source side heat exchanger 2*a* is connected to an upper confluent pipe 8*a* and a header-type upper distributor 7*a*. The upper confluent pipe 8*a* serves as a refrigerant outlet when the upper heat source side heat exchanger 2*a* operates as an evaporator (that is, during heating operation), and is connected to the flow channel switch 12. The upper distributor 7*a* serves as a refrigerant inlet when the upper heat source side heat exchanger 2*a* operates as an evaporator (that is, during heating operation), and includes a header, and branch pipes each connected from the header to a corresponding one of the heat transfer pipes 40 of the upper heat source side heat exchanger 2*a*. Additionally, during heating operation, refrigerant flowing into the upper distributor 7*a* is distributed from each of the branch pipes to the corresponding one of the heat transfer pipes 40 of the upper heat source side heat exchanger 2*a*, and flows out from the upper confluent pipe 8*a*.

Meanwhile, each of the heat transfer pipes 40 of the lower heat source side heat exchanger 2*b* is connected to a lower confluent pipe 8*b* and a header-type lower distributor 7*b*. The lower confluent pipe 8*b* serves as a refrigerant outlet when the lower heat source side heat exchanger 2*b* operates as an evaporator (that is, during heating operation), and is connected to the flow channel switch 12. The lower distributor 7*b* serves as a refrigerant inlet when the lower heat source side heat exchanger 2*b* operates as an evaporator (that is, during heating operation), and includes a header, and branch pipes each connected from the header to a corresponding one of the heat transfer pipes 40 of the lower heat source side heat exchanger 2*b*. Additionally, during heating operation, refrigerant flowing into the lower distributor 7*b* is distributed from each of the branch pipes to the corresponding one of the heat transfer pipes 40 of the lower heat source side heat exchanger 2*b*, and flows out from the lower confluent pipe 8*b*.

The fan 3 sends air to the upper heat source side heat exchanger 2*a* and the lower heat source side heat exchanger 2*b*. An air outlet 1*b* is formed in the top face of the housing 11, and the fan 3 is provided in the air outlet 1*b* (in other words, in the top face of the housing 11). In other words, the fan 3 is provided such that an angle is formed between the air current discharged from the air outlet 1*b* and the air current flowing through the upper heat source side heat exchanger 2*a* and the lower heat source side heat exchanger 2*b*. Note that the fan 3 also keeps the compressor 4, the accumulator 5, and the flow channel switch 12 from interfering with the air current inside the housing 11. As a result, air suctioned into the housing 11 from the air inlet 1*a* turns inside the housing 11, and is discharged in a roughly vertical direction from the air outlet 1*b* formed in the top face of the housing 11.

The expansion devices 15 (first expansion device 15*a* and second expansion device 15*b*) are each provided between a corresponding one of the use side heat exchangers 16 and the branch circuit 9, and adjust the state of refrigerant by adjusting the flow rate. The expansion devices 15 are each made up of an expansion device, typically a linear electronic expansion valve (LEV), for example, or a device such as an opening and closing valve that switches on and off the flow of refrigerant by opening and closing. The accumulator 5 is provided on the suction side of the compressor 4, and accumulates refrigerant. Additionally, the compressor 4 is configured to suction and compress the gas-phase refrigerant from among the refrigerant accumulated in the accumulator 5. Note that in a case in which the air conditioning device 10 runs only when a configuration is ensured that liquid back-flow into the compressor 4 is controlled to be prevented, it is not particularly necessary to provide the accumulator 5.

As described above, the branch circuit 9 distributes refrigerant having a gas-liquid mixture ratio corresponding to the heat load to each of the upper heat source side heat exchanger 2*a* and the lower heat source side heat exchanger 2*b*. Specifically, as described later, the heat load on the upper heat source side heat exchanger 2*a* is greater than the heat load on the lower heat source side heat exchanger 2*b*. For this reason, the branch circuit 9 is configured to supply the upper heat source side heat exchanger 2*a* with refrigerant of low quality compared to the refrigerant supplied to the lower heat source side heat exchanger 2*b*.

The branch circuit 9 according to Embodiment 1 is made up of a gas-liquid separator 6, a main flow pipe 20, a first branch pipe 21*a*, and a second branch pipe 21*b*. The gas-liquid separator 6 is provided between the expansion devices 15 and the heat source side heat exchangers 2, and separates two-phase gas-liquid refrigerant flowing out from the expansion devices 15 during heating operation into gas-phase refrigerant and liquid-phase refrigerant. One end of the main flow pipe 20 is connected to the bottom part of the gas-liquid separator 6, for example, and the main flow pipe 20 supplies liquid-phase refrigerant or two-phase gas-liquid refrigerant to the downstream side during heating operation. One end of the first branch pipe 21*a* is connected to the main flow pipe 20, while the other end is connected to the upper distributor 7*a* of the upper heat source side heat exchanger 2*a*. In Embodiment 1, the main flow pipe 20 includes a vertical pipe part 20*a* disposed in the vertical direction. Additionally, one end of the first branch pipe 21*a* is connected to the lower end of the vertical pipe part 20*a*, for example. One end of the second branch pipe 21*b* is connected to the main flow pipe 20, while the other end is connected to the lower distributor 7*b* of the lower heat source side heat exchanger 2*b*. In Embodiment 1, one end of the second branch pipe 21*b* is connected to the first branch pipe 21*a* at a position farther upstream in the refrigerant flow direction than the connection position between the vertical pipe part 20*a* and the first branch pipe 21*a*. As illustrated in FIG. 4, the second branch pipe 21*b* is disposed along the horizontal direction, and the connection site between the second branch pipe 21*b* and the vertical pipe part 20*a* of the main flow pipe 20 forms a T-junction. Also, in Embodiment 1, one end of the second branch pipe 21*b* is configured to project into the inside of the vertical pipe part 20*a*.

During heating operation, liquid-phase refrigerant or two-phase gas-liquid refrigerant flowing into the main flow pipe 20 from the gas-liquid separator 6 flows from the upper part to the lower part inside the vertical pipe part 20*a*. Subsequently, this refrigerant is distributed at the connection site between the second branch pipe 21*b* and the vertical pipe part 20*a* of the main flow pipe 20, and one portion of the refrigerant passes through the second branch pipe 21*b* to flow into the lower distributor 7*b* of the lower heat source side heat exchanger 2*b*. Meanwhile, the remaining portion of the refrigerant passes through the first branch pipe 21*a* to flow into the upper distributor 7*a* of the upper heat source side heat exchanger 2*a*. On the other hand, during cooling operation, liquid-phase refrigerant flowing out from the upper distributor 7*a* passes through the first branch pipe 21*a* and the main flow pipe 20 to flow into the gas-liquid separator 6. Also, liquid-phase refrigerant flowing out from the lower distributor 7*b* passes through the second branch pipe 21*b* and the main flow pipe 20 to flow into the gas-liquid separator 6.

Also, the air conditioning device 10 according to Embodiment 1 is provided with a gas-phase refrigerant outflow pipe 23 through which gas-phase refrigerant flows out from the gas-liquid separator 6, and a flow rate control device 13 provided in the gas-phase refrigerant outflow pipe 23. One end of the gas-phase refrigerant outflow pipe 23 is connected to the upper part of the gas-liquid separator 6, for example. Also, the other end of the gas-phase refrigerant outflow pipe 23 is connected to a pipe 42 that connects the heat source side heat exchangers 2 and the flow channel switch 12. In other words, the other end of the gas-phase refrigerant outflow pipe 23 is connected to the pipe 42 that connects the heat source side heat exchangers 2 to the suction side of the compressor 4 during heating operation. The flow rate control device 13 adjusts the flow rate of gas-phase refrigerant from the gas-liquid separator 6, and is made up of an expansion device, typically a linear electronic expansion valve (LEV), for example, or a device such as an opening and closing valve that switches on and off the flow of refrigerant by opening and closing. Note that in Embodiment 1, a linear electronic expansion valve is used as the flow rate control device 13.

Herein, the pipe 42 corresponds to a suction pipe of the present invention. Note that the gas-phase refrigerant outflow pipe 23 and the flow rate control device 13 are not essential components. Even without these components, refrigerant having a gas-liquid mixture ratio corresponding to the heat load can be distributed to each of the upper heat source side heat exchanger 2*a* and the lower heat source side heat exchanger 2*b*. However, by providing the gas-phase refrigerant outflow pipe 23 and the flow rate control device 13, the heat exchanging performance of the heat source side heat exchangers 2 can be improved further. An example of a control method of the flow rate control device 13 will be described later in Embodiment 5.

Next, exemplary operation of the air conditioning device 10 in the case in which the upper heat source side heat exchanger 2*a* and the lower heat source side heat exchanger 2*b* operate as evaporators (heating operation) will be described with reference to FIG. 1.

First, refrigerant becomes compressed gas-phase refrigerant in the compressor 4, and flows out from the compressor 4, through the flow channel switch 12, and to the first use side heat exchanger 16*a* and the second use side heat exchanger 16*b*. Subsequently, the gas-phase refrigerant rejects heat in the first use side heat exchanger 16*a* and the second use side heat exchanger 16*b* to condense from the gas phase to the liquid phase, and the condensed refrigerant is decompressed in the first expansion device 15*a* and the second expansion device 15*b* to enter a two-phase gas-liquid state. Subsequently, refrigerant in the two-phase gas-liquid state flows into the gas-liquid separator 6, and gas-phase refrigerant passes through the flow rate control device 13 to flow into the flow channel switch 12, while the other two-phase gas-liquid or liquid-phase refrigerant flows into the main flow pipe 20. The two-phase gas-liquid or liquid-phase refrigerant flowing into the main flow pipe 20 is distributed to the upper distributor 7*a* and the lower distributor 7*b* via the first branch pipe 21*a* and the second branch pipe 21*b*. The two-phase gas-liquid or liquid-phase refrigerant flowing into each of the upper distributor 7*a* and the lower distributor 7*b* is distributed into the multiple heat transfer pipes 40, and evaporates by receiving heat from air sent by the fan 3. With this operation, the ratio of gas in the two-phase gas-liquid state rises in the refrigerant flowing inside the heat transfer pipes 40 of each of the upper heat source side heat exchanger 2*a* and the lower heat source side heat exchanger 2*b*. Subsequently, refrigerant flowing out from each of the heat transfer pipes 40 passes through the upper confluent pipe 8*a* and the lower confluent pipe 8*b*, converges with the flow from the flow rate control device 13, and passes through the flow channel switch 12 to flow to the accumulator 5. Subsequently, refrigerant inside the accumulator 5 is suctioned into the compressor 4.

Figure 5:
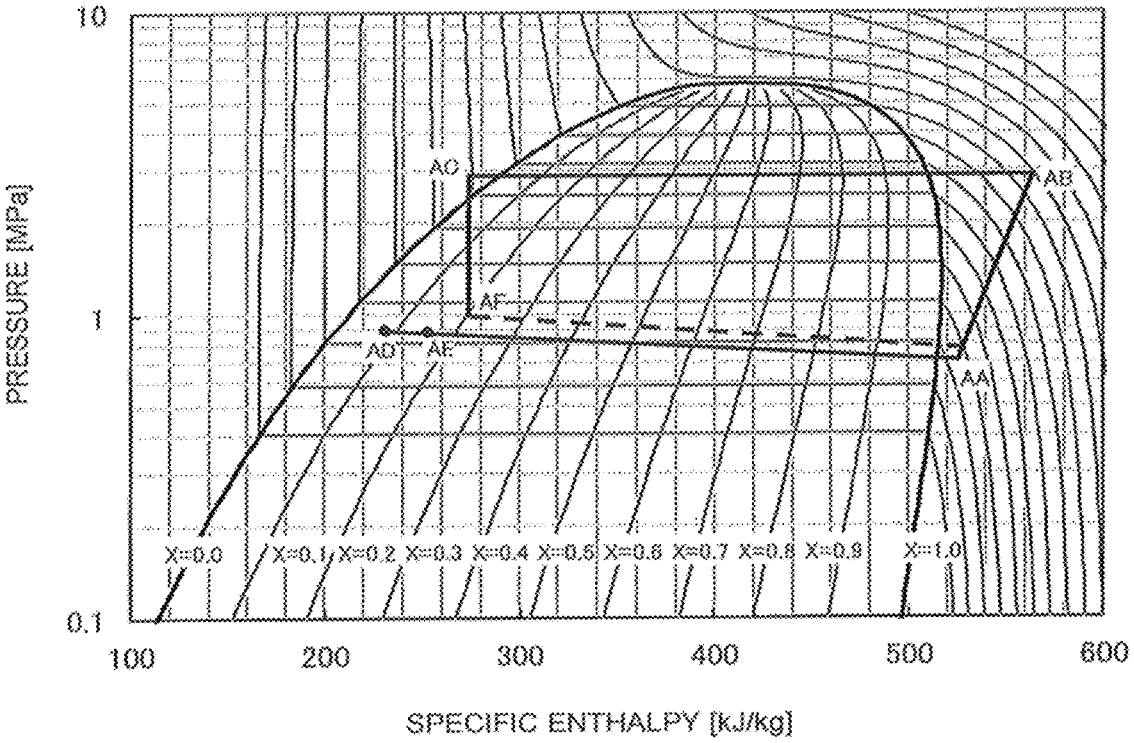
FIG. 5 is a P-H cycle diagram for the case of using hydrofluorocarbon refrigerant R410a in the air conditioning device according to Embodiment 1 of the present invention.

FIG. 5 is a P-H cycle diagram for the case of using hydrofluorocarbon refrigerant R410a in the air conditioning device according to Embodiment 1 of the present invention. Note that FIG. 5 illustrates the above case of heating operation in which the upper heat source side heat exchanger 2*a* and the lower heat source side heat exchanger 2*b* operate as evaporators. Also, in FIG. 5, the solid lines in an approximate trapezoidal shape indicate the cycle operating state. In addition, the lines from X=0.1 to X=0.9 extending from the horizontal specific enthalpy axis are constant quality lines indicating the gas-phase ratio of the refrigerant. Also, the solid convex line is the saturation line, from which the region to the left is gas, and the region to the right is liquid.

The refrigeration cycle during heating operation described above runs from point AA to point AB, point AC, point AF, point AE, and point AD. Point AB indicates superheated gas at the discharge part of the compressor 4. Refrigerant rejects heat in the first use side heat exchanger 16*a* and the second use side heat exchanger 16*b*, thus becoming the subcooled liquid of point AC at the outlets of the first use side heat exchanger 16*a* and the second use side heat exchanger 16*b*. Subsequently, refrigerant is decompressed by passing through the first expansion device 15*a* and the second expansion device 15*b*, and enters a two-phase gas-liquid state with a quality of approximately 0.2 at point AF. This refrigerant in the two-phase gas-liquid state flows into the gas-liquid separator 6 and is separated into gas and liquid. While the gas-phase refrigerant passes through the flow rate control device 13 to flow into the accumulator 5 at point AA, the two-phase gas-liquid or liquid-phase refrigerant flows into the main flow pipe 20. The two-phase gas-liquid or liquid-phase refrigerant flowing into the main flow pipe 20 is distributed to the upper distributor 7*a* and the lower distributor 7*b* via the first branch pipe 21*a* and the second branch pipe 21*b*. At this time, two-phase gas-liquid refrigerant at point AD having a relatively low quality flows into the upper distributor 7*a*, while two-phase gas-liquid refrigerant at point AE having a relatively high quality flows into the lower distributor 7*b*. Subsequently, refrigerant evaporates in the heat transfer pipes 40 of each of the upper heat source side heat exchanger 2*a* and the lower heat source side heat exchanger 2*b*, and reaches the state point at point AA. Note that the branching of refrigerant of different quality in the main flow pipe 20, the first branch pipe 21*a*, and the second branch pipe 21*b* will be described later.

Herein, in the case in which the upper heat source side heat exchanger 2*a* and the lower heat source side heat exchanger 2*b* operate as evaporators, refrigerant in a two-phase gas-liquid state flows into the upper distributor 7*a* and the lower distributor 7*b*. Two-phase gas-liquid refrigerant is a mixture of gas and liquid at different densities, and the refrigerant in each phase flows while maintaining an equilibrium of kinetic energy that is dependent on the flow velocity, and potential energy that is determined by gravity. To raise the heat exchanging efficiency of the upper heat source side heat exchanger 2*a* and the lower heat source side heat exchanger 2*b*, it is desirable for liquid-phase refrigerant with low enthalpy to be distributed from the upper distributor 7*a* and the lower distributor 7*b* into each of the heat transfer pipes 40 corresponding to the heat load.

In the heat source side unit 1 of the air conditioning device 10, the distance from the upper heat source side heat exchanger 2*a* to the fan 3 is different from the distance from the lower heat source side heat exchanger 2*b* to the fan 3. For this reason, the flow rate of air flowing into the upper heat source side heat exchanger 2*a* is also different from the flow rate of air flowing into the lower heat source side heat exchanger 2*b*. In other words, the upper heat source side heat exchanger 2*a* and the lower heat source side heat exchanger 2*b* have different heat loads. Specifically, the inflow of air to the upper heat source side heat exchanger 2*a* close to the fan 3 is relatively greater than that of the lower heat source side heat exchanger 2*b*, and consequently, the heat load of the upper heat source side heat exchanger 2*a* is greater than that of the lower heat source side heat exchanger 2*b*.

Note that as a configuration other than the above by which the heat load of the upper heat source side heat exchanger 2*a*, for example, the number of heat transfer fins 41 of the upper heat source side heat exchanger 2*a* is provided more densely than the lower heat source side heat exchanger 2*b*, and the heat transfer surface area of the upper heat source side heat exchanger 2*a* becomes relatively greater than that of the lower heat source side heat exchanger 2*b* in some cases. As another example, the shape of the heat transfer fins 41 of the upper heat source side heat exchanger 2*a* is different from that of the lower heat source side heat exchanger 2*b*, and the heat transfer efficiency determined by the shape of the heat transfer fins 41 is greater than that of the lower heat source side heat exchanger 2*b* in some cases.

To improve the heat exchanger efficiency during evaporation, which is important as a function of the air conditioning device 10, it is desirable to distribute, to each of the heat source side heat exchangers 2, liquid-phase refrigerant corresponding to the ratio of the heat loads. Consequently, it is necessary to cause more liquid-phase refrigerant with a large amount of latent heat to flow into the upper heat source side heat exchanger 2*a* compared to the lower heat source side heat exchanger 2*b*. As described above, the upper heat source side heat exchanger 2*a* and the lower heat source side heat exchanger 2*b* are provided with the upper distributor 7*a* and the lower distributor 7*b*, respectively, upstream of the heat transfer pipes 40. Additionally, refrigerant is distributed to the upper distributor 7*a* and the lower distributor 7*b* via the main flow pipe 20, the first branch pipe 21*a*, and the second branch pipe 21*b*.

Figure 6:
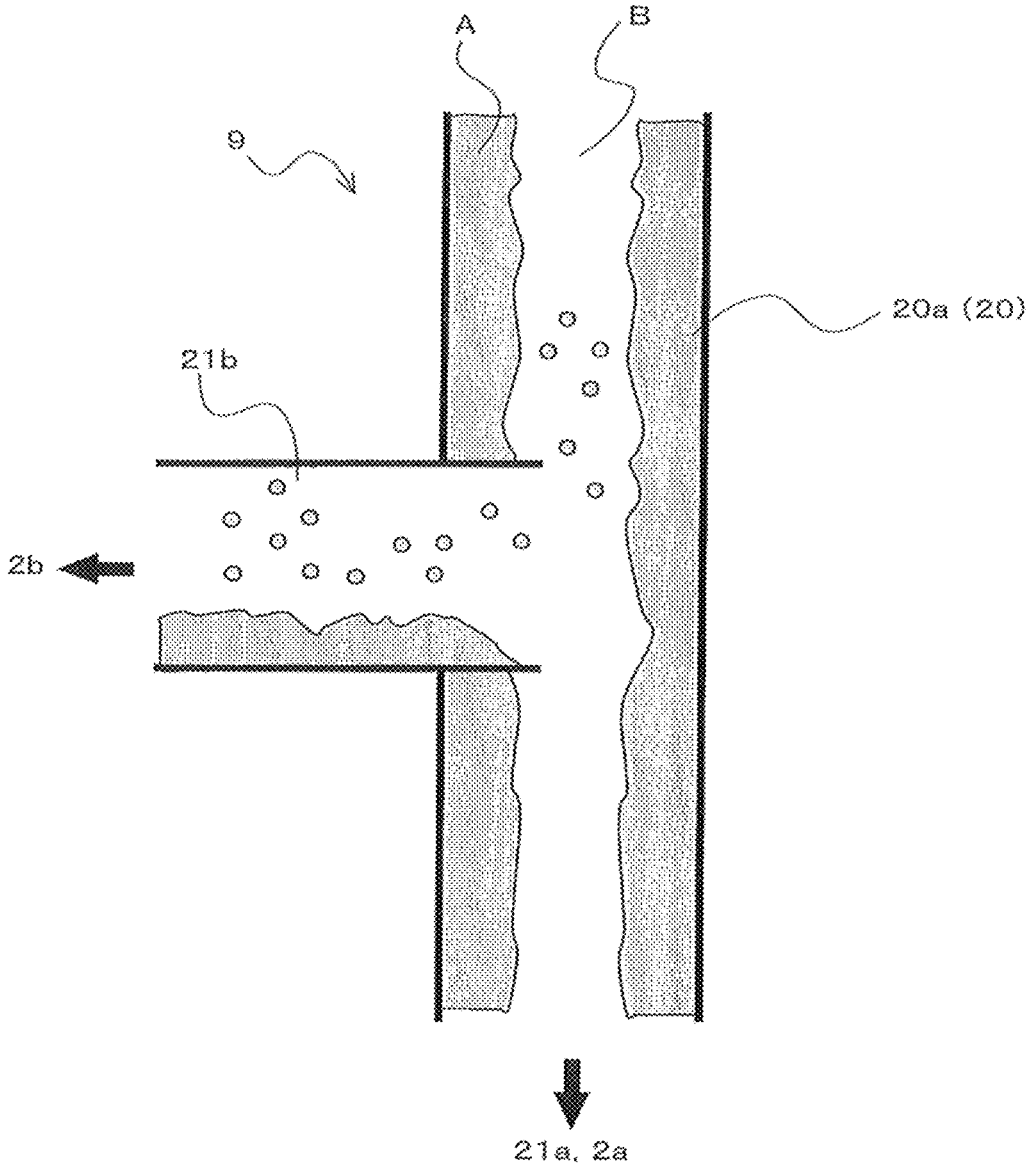
FIG. 6 is an enlarged view (cross-section view) illustrating the principle parts in the vicinity of the vertical pipe part of the branch circuit in the air conditioning device according to Embodiment 1 of the present invention, and illustrates a fluid state of refrigerant flowing through the vertical pipe part and a second branch pipe.

FIG. 6 is an enlarged view (cross-section view) illustrating the principle parts in the vicinity of the vertical pipe part of the branch circuit in the air conditioning device according to Embodiment 1 of the present invention, and illustrates a fluid state of refrigerant flowing through the vertical pipe part and a second branch pipe.

In the case in which the upper heat source side heat exchanger 2*a* and the lower heat source side heat exchanger 2*b* operate as evaporators, it is necessary to cause more liquid-phase refrigerant with a large amount of latent heat to flow into the upper heat source side heat exchanger 2*a* compared to the lower heat source side heat exchanger 2*b*. Consequently, it is necessary to cause more liquid-phase refrigerant to flow into the upper distributor 7*a* compared to the lower distributor 7*b*.

In the case in which the upper heat source side heat exchanger 2*a* and the lower heat source side heat exchanger 2*b* operate as evaporators, inside the main flow pipe 20, two-phase gas-liquid refrigerant flows from the upper part in a vertically downward direction. At this time, as illustrated in FIG. 6, inside the main flow pipe 20, liquid-phase refrigerant is unevenly distributed in the radially outward direction, that is, on the sides of the wall ("A" in FIG. 6), while gas-phase refrigerant is unevenly distributed in the radially inward direction ("B" in FIG. 6). As liquid-phase refrigerant is relatively denser than gas-phase refrigerant, the speed of descent increases due to the effect of gravity. Consequently, relatively more gas-phase refrigerant flows into the second branch pipe 21*b* from the radially inward side of the main flow pipe 20. Meanwhile, the liquid-phase refrigerant having greater inertial force is less likely to turn and flow into the second branch pipe 21*b*, and thus the rate of flow into the second branch pipe 21*b* is relatively low.

From these properties, the flow rate of liquid-phase refrigerant that flows into the second branch pipe 21*b* is relatively lower than that of the outlet of the main flow pipe 20, or in other words, the flow rate of liquid-phase refrigerant that flows into the first branch pipe 21*a* is relatively higher. Consequently, by connecting the lower distributor 7*b* to the second branch pipe 21*b*, and connecting the upper distributor 7*a* to the first branch pipe 21*a* connected at a position below the lower distributor 7*b* in the main flow pipe 20, relatively more liquid-phase refrigerant can be made to flow into the upper heat source side heat exchanger 2*a* having a large heat load. In other words, the upper heat source side heat exchanger 2*a* having a large heat load can be supplied with refrigerant of low quality compared to the refrigerant supplied to the lower heat source side heat exchanger 2*b*.

Note that the gas-liquid mixture ratio of the refrigerant flowing into the second branch pipe 21*b* can be adjusted corresponding to how far the leading end of the second branch pipe 21*b* projects into the main flow pipe 20. More specifically, as the leading end (that is, the opening) of the second branch pipe 21*b* is disposed closer to the pipe axis of the main flow pipe 20, gas-phase refrigerant is more likely to flow and liquid-phase refrigerant is less likely to flow into the second branch pipe 21*b*.

Figure 7:
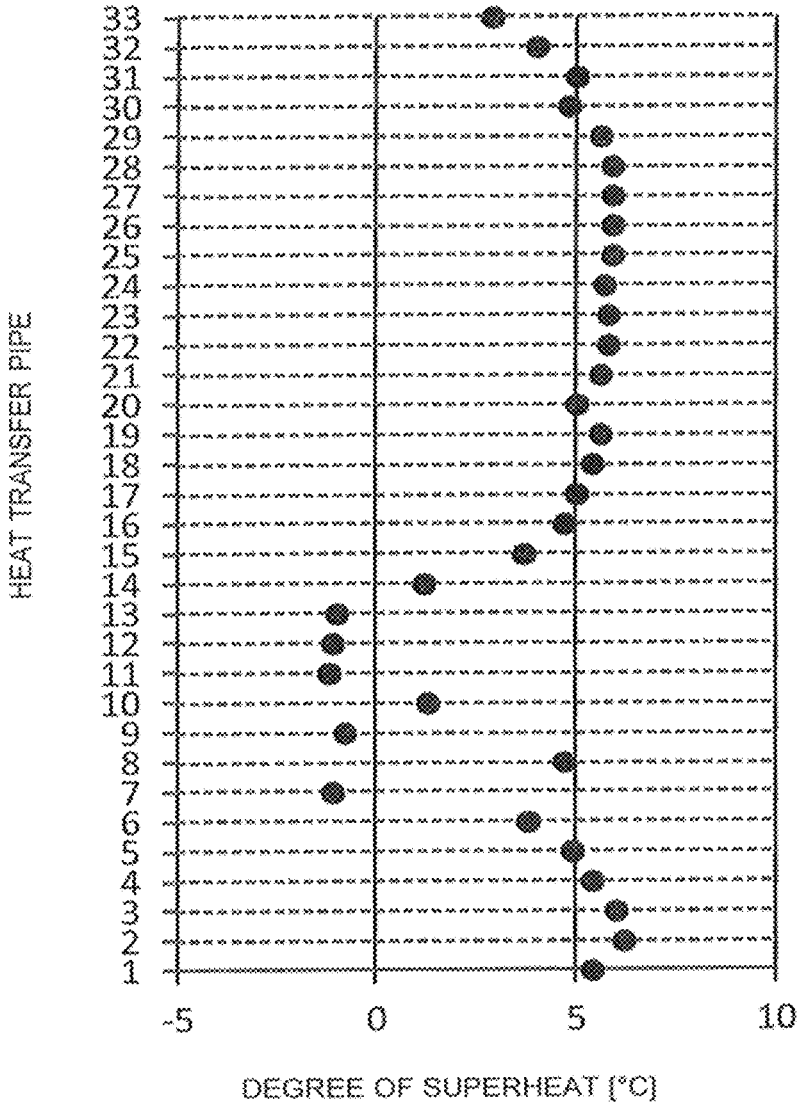
FIG. 7 is a diagram illustrating the degree of superheat at the heat transfer pipe outlets of an upper heat source side heat exchanger and a lower heat source side heat exchanger of the air conditioning device according to Embodiment 1 of the present invention.

FIG. 7 is a diagram illustrating the degree of superheat at the heat transfer pipe outlets of an upper heat source side heat exchanger and a lower heat source side heat exchanger of the air conditioning device according to Embodiment 1 of the present invention. Note that the vertical axis in FIG. 7 indicates the respective heat transfer pipes 40 of the upper heat source side heat exchanger 2*a* and the lower heat source side heat exchanger 2*b*, which are numbered starting from the heat transfer pipe 40 disposed on the bottom and proceeding to the heat transfer pipe 40 disposed on the top. The numbers from "1" to "16" indicate the heat transfer pipes 40 of the lower heat source side heat exchanger 2*b*, while the numbers from "17" to "33" indicate the heat transfer pipes 40 of the upper heat source side heat exchanger 2*a*. Also, the degree of superheat indicated on the horizontal axis indicates the degree of superheat at the outlet of each of the heat transfer pipes 40 in the case in which the upper heat source side heat exchanger 2*a* and the lower heat source side heat exchanger 2*b* operate as evaporators. The degree of superheat refers to the value obtained by subtracting the temperature of the two-phase gas-liquid refrigerant flowing into each of the heat transfer pipes 40 from the temperature of the refrigerant at the outlet of a corresponding one of the heat transfer pipes 40.

As illustrated in FIG. 7, by connecting the upper heat source side heat exchanger 2*a* and the lower heat source side heat exchanger 2*b* in parallel using the branch circuit 9 as in Embodiment 1, the distribution of the degree of superheat can be equalized between the upper heat source side heat exchanger 2*a* and the lower heat source side heat exchanger 2*b*.

According to Embodiment 1 above, in the case in which the upper heat source side heat exchanger 2*a* and the lower heat source side heat exchanger 2*b* operate as evaporators, by using the branch circuit 9 to cause relatively more liquid-phase refrigerant to flow into the upper heat source side heat exchanger 2*a* having a larger heat load, the heat exchanging performance (heat exchanging efficiency) of the upper heat source side heat exchanger 2*a* and the lower heat source side heat exchanger 2*b* can be increased, and the system performance of the air conditioning device 10 as a whole can be improved.

Note that the connection configuration of the main flow pipe 20 and the second branch pipe 21*b* illustrated in Embodiment 1 above is merely one example. The upper heat source side heat exchanger 2*a* having a large heat load is only required to be supplied with refrigerant of low quality compared to the refrigerant supplied to the lower heat source side heat exchanger 2*b*. As long as this condition is satisfied, the installation attitude of the main flow pipe 20 and the second branch pipe 21*b*, the connection angle of the second branch pipe 21*b* to the main flow pipe 20, and the cross-sectional shape of the main flow pipe 20 and the second branch pipe 21*b* are arbitrary.

Embodiment 2

The branch circuit that causes relatively more liquid-phase refrigerant to flow into the upper heat source side heat exchanger 2*a* having a large heat load is not limited to that illustrated in Embodiment 1. The second branch pipe 21*b* is only required to have an end connected somewhere between the expansion devices 15 and the connection site between the main flow pipe 20 and the first branch pipe 21*a*. For example, the branch circuit may also be configured as follows. Note that in Embodiment 2, parts having the same configuration as Embodiment 1 are denoted with the same reference signs, and description of such parts will be reduced or omitted.

Figure 8:
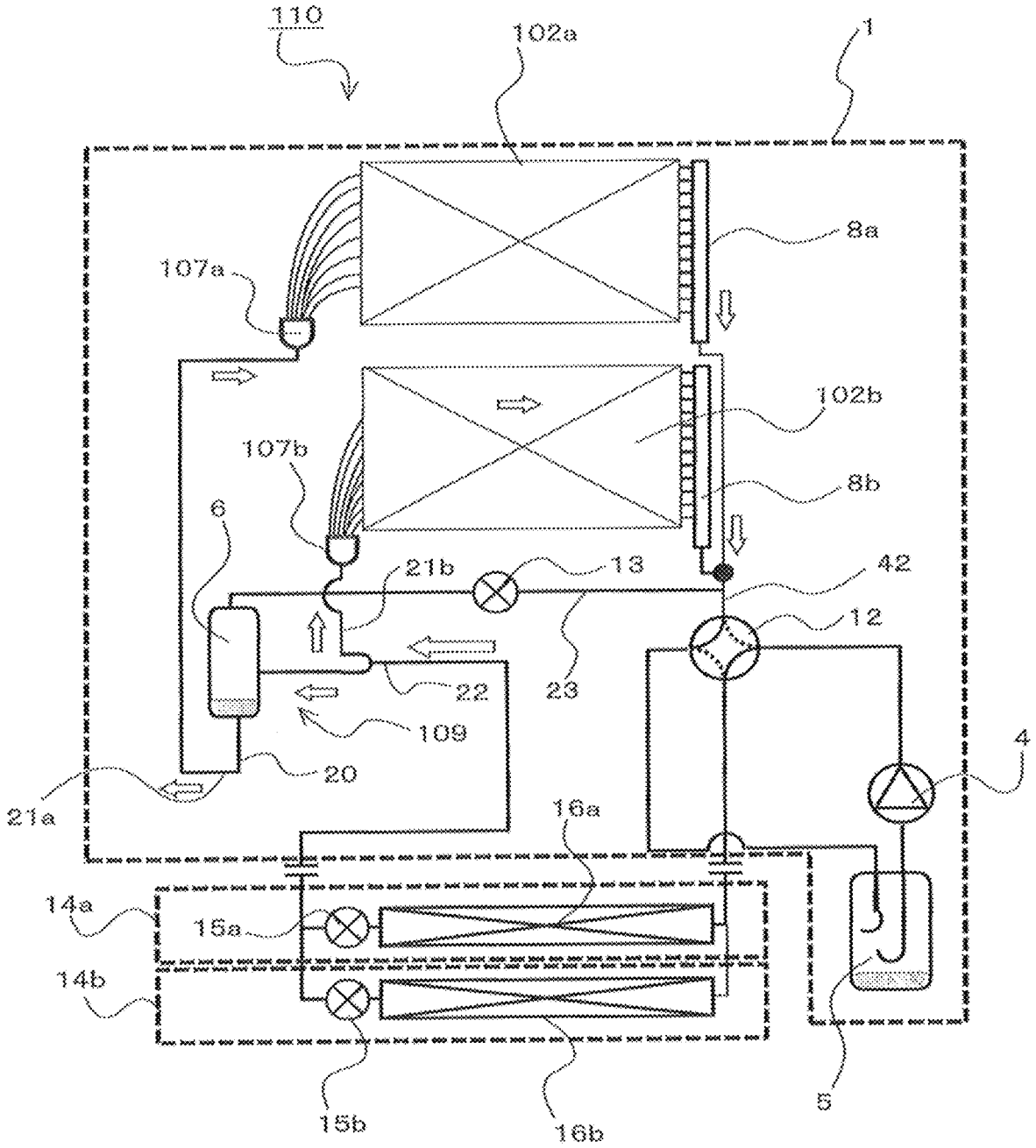
FIG. 8 is a refrigerant circuit diagram illustrating an example of an air conditioning device according to Embodiment 2 of the present invention.

FIG. 8 is a refrigerant circuit diagram illustrating an example of an air conditioning device according to Embodiment 2 of the present invention. An air conditioning device 110 according to Embodiment 2 differs from the air conditioning device 10 according to Embodiment 1 in the configuration of the heat source side heat exchangers 102 and the branch circuit 109.

The heat source side heat exchangers 102 are provided with non-header-type distributors 107 instead of the header-type distributors 7 illustrated in Embodiment 1. More specifically, the air conditioning device 110 according to Embodiment 2 is provided with two heat source side heat exchangers 102 (an upper heat source side heat exchanger 102*a* and a lower heat source side heat exchanger 102*b*), similarly to Embodiment 1. Additionally, each of the heat transfer pipes 40 of the upper heat source side heat exchanger 102*a* is connected to an upper distributor 107*a*, while each of the heat transfer pipes 40 of the lower heat source side heat exchanger 102*b* is connected to a lower distributor 107*b*. Also, similarly to Embodiment 1, the heat load on the upper heat source side heat exchanger 102*a* is greater than the heat load on the lower heat source side heat exchanger 102*b*.

Note that the distributors 107 are merely one example. The heat source side heat exchangers 102 may also use the header-type distributors 7 illustrated in Embodiment 1. Also, the non-header-type distributors 107 obviously may also be used in the heat source side heat exchangers according to Embodiment 1 and Embodiments 3 to 8 described below.

A branch circuit 109 according to Embodiment 2 is provided with a gas-liquid separator 6, a main flow pipe 20, a first branch pipe 21*a*, and a second branch pipe 21*b*, similarly to the branch circuit 9 illustrated in Embodiment 1. One end of the first branch pipe 21*a* is connected to the main flow pipe 20, while the other end is connected to the upper distributor 107*a* of the upper heat source side heat exchanger 102*a*. Also, one end of the second branch pipe 21*b* is connected at a position upstream of the gas-liquid separator 6 during heating operation, while the other end is connected to the lower distributor 107*b* of the lower heat source side heat exchanger 102*b*. Additionally, the second branch pipe 21*b* is connected to an inflow pipe 22 that connects the expansion devices 15 and the gas-liquid separator 6. The connection site between the inflow pipe 22 and the second branch pipe 21*b* forms a Y-junction, for example. At the connection site between the inflow pipe 22 and the second branch pipe 21*b*, liquid-phase refrigerant is branched in substantially equal quantities. Consequently, during heating operation in which the upper heat source side heat exchanger 102*a* and the lower heat source side heat exchanger 102*b* operate as evaporators, refrigerant that has passed through the gas-liquid separator 6 and has been reduced in quality flows into the upper distributor 107*a*, whereas refrigerant of relatively higher quality flows into the lower distributor 107*b*.

Also in Embodiment 2 above, in the case in which the upper heat source side heat exchanger 102*a* and the lower heat source side heat exchanger 102*b* operate as evaporators, by using the branch circuit 109 to cause relatively less liquid-phase refrigerant to flow into the lower heat source side heat exchanger 102*b* having a smaller heat load, the heat exchanging performance (heat exchanging efficiency) of the upper heat source side heat exchanger 102*a* and the lower heat source side heat exchanger 102*b* can be increased, and the system performance of the air conditioning device 110 as a whole can be improved.

Embodiment 3

As described above, the second branch pipe 21*b* is only required to have the end connected somewhere between the expansion devices 15 and the connection site between the main flow pipe 20 and the first branch pipe 21*a*. For this reason, the branch circuit may also be configured as follows, for example. Note that in Embodiment 3, parts having the same configuration as Embodiment 1 or Embodiment 2 are denoted with the same reference signs. Also, items not described in Embodiment 3 are similar to those of Embodiment 1 or Embodiment 2.

Figure 9:
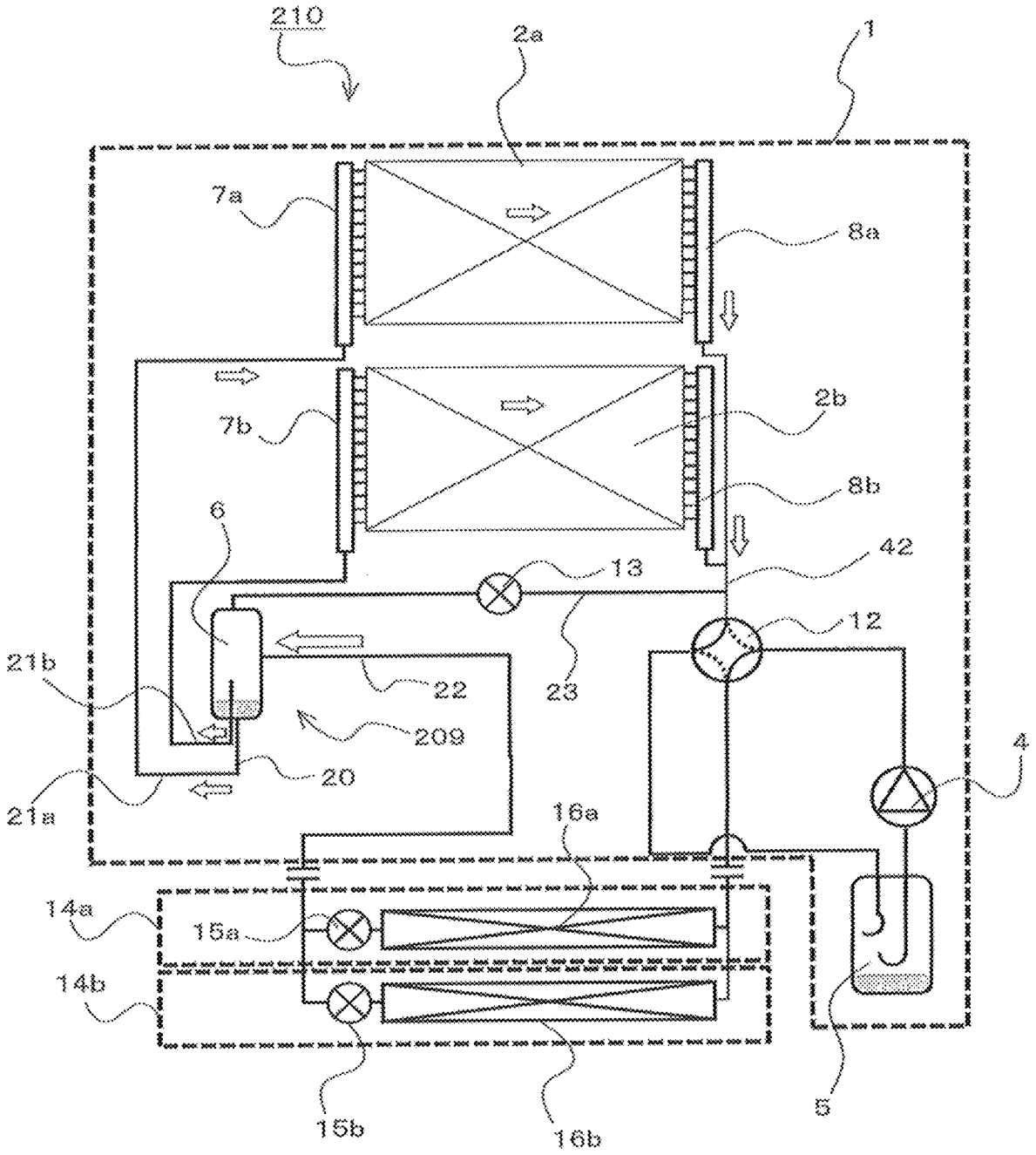
FIG. 9 is a refrigerant circuit diagram illustrating an example of an air conditioning device according to Embodiment 3 of the present invention.
Figure 10:
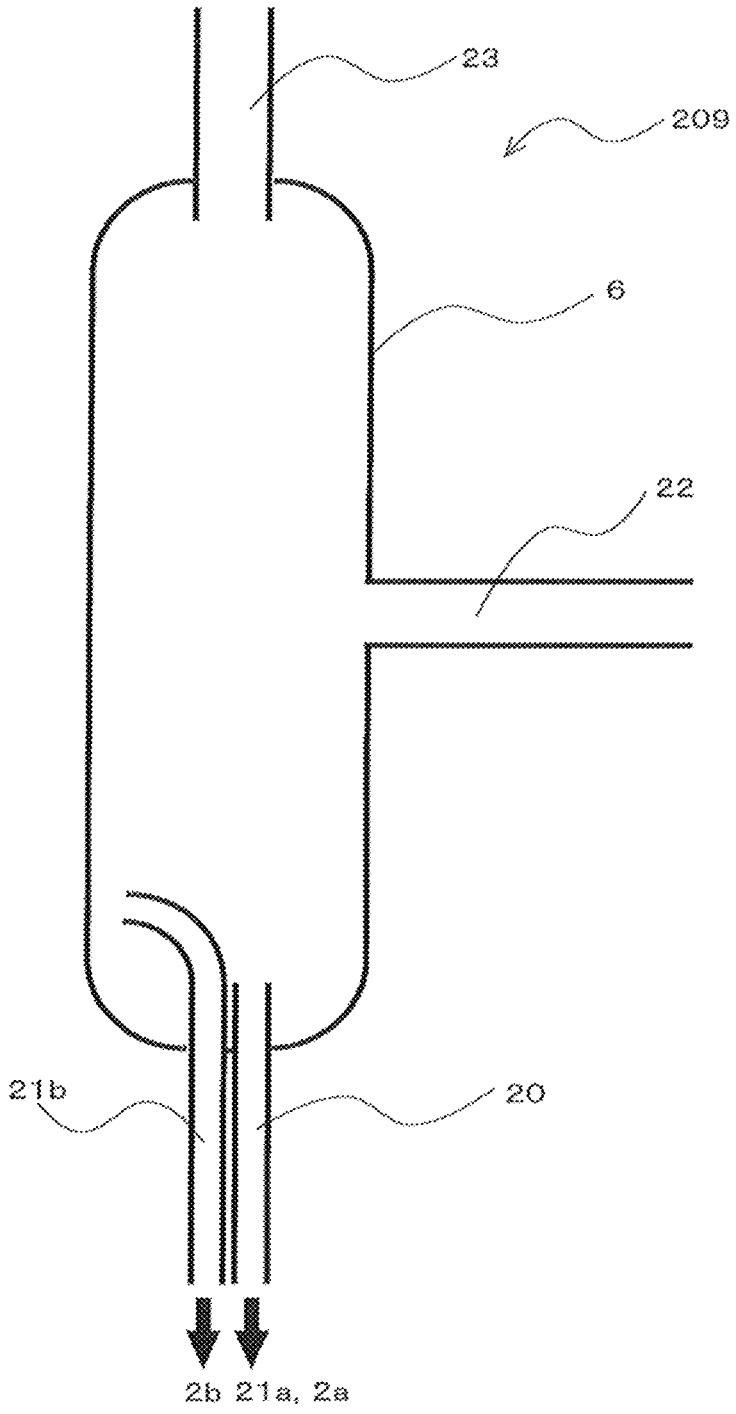
FIG. 10 is an enlarged view (cross-section view) illustrating the principle parts in the vicinity of a gas-liquid separator of a branch circuit in the air conditioning device according to Embodiment 3 of the present invention.
Figure 11:
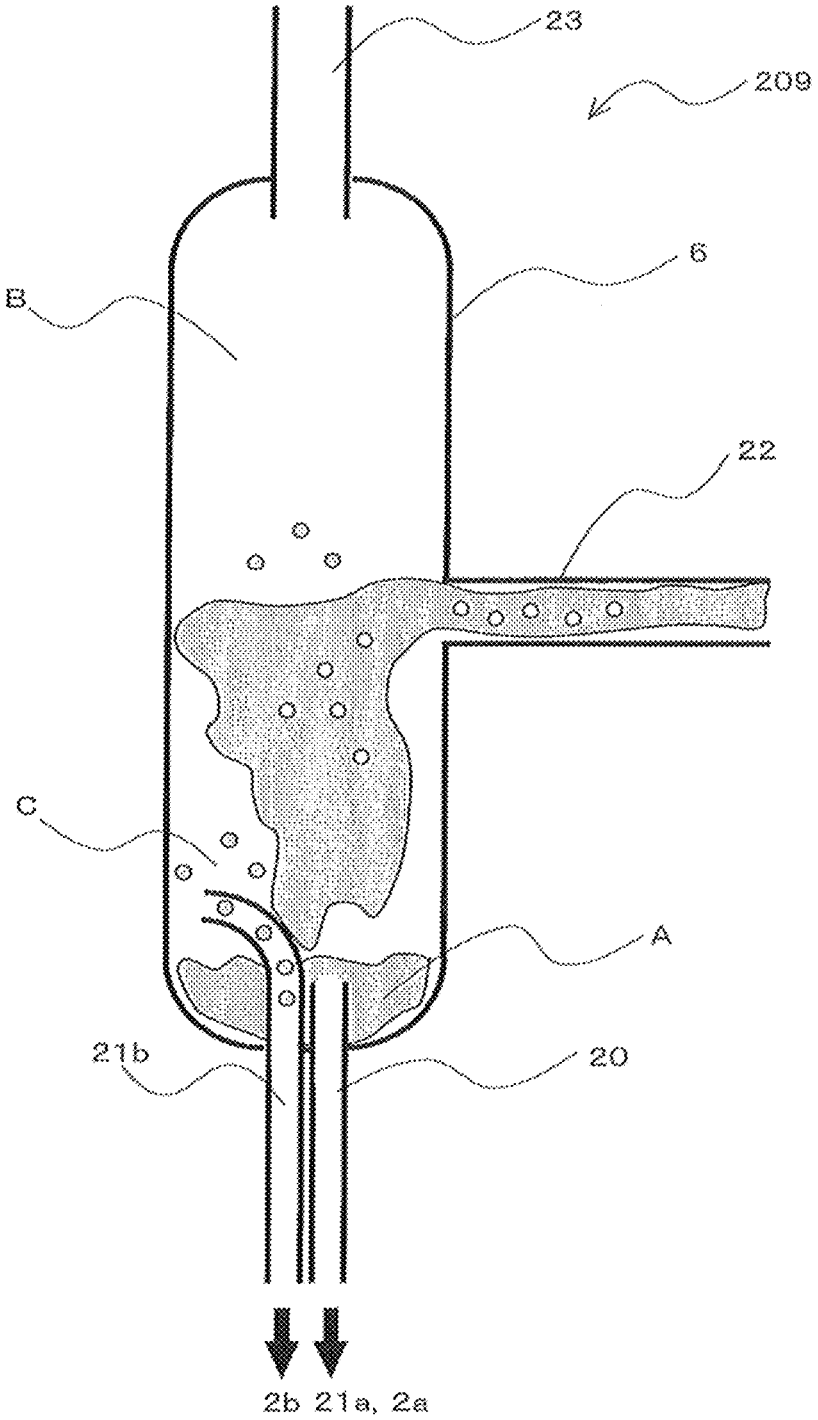
FIG. 11 is an enlarged view (cross-section view) illustrating the principle parts in the vicinity of the gas-liquid separator of the branch circuit in the air conditioning device according to Embodiment 3 of the present invention, and illustrates a fluid state of refrigerant flowing through the gas-liquid separator.

FIG. 9 is a refrigerant circuit diagram illustrating an example of an air conditioning device according to Embodiment 3 of the present invention. FIG. 10 is an enlarged view (cross-section view) illustrating the principle parts in the vicinity of a gas-liquid separator of a branch circuit in the air conditioning device. Also, FIG. 11 is an enlarged view (cross-section view) illustrating the principle parts in the vicinity of the gas-liquid separator of the branch circuit in the air conditioning device, and illustrates a fluid state of refrigerant flowing through the gas-liquid separator.

An air conditioning device 210 according to Embodiment 3 differs from the air conditioning device 10 according to Embodiment 1 in the configuration of the branch circuit 209.

In the gas-liquid separator 6 according to Embodiment 3, the inflow pipe 22 that connects the expansion devices 15 and the gas-liquid separator 6 is connected approximately horizontally, for example, in the central part of a side wall of the gas-liquid separator 6, for example. Also, the gas-phase refrigerant outflow pipe 23 that causes gas-phase refrigerant to flow out from the gas-liquid separator 6 is connected to the top part of the gas-liquid separator 6, for example. Also, the main flow pipe 20 is connected to the bottom part of the gas-liquid separator 6, for example. Additionally, in Embodiment 3, the second branch pipe 21*b* is also connected to the bottom part of the gas-liquid separator 6, for example. The ends (that is, the openings) of the main flow pipe 20 and the second branch pipe 21*b* project inward into the gas-liquid separator 6. In other words, the main flow pipe 20 and the second branch pipe 21*b* open inside the gas-liquid separator 6. Additionally, the main flow pipe 20 opens at a position below the second branch pipe 21*b*.

In the case in which the upper heat source side heat exchanger 2*a* and the lower heat source side heat exchanger 2*b* operate as evaporators, two-phase gas-liquid refrigerant flows into the gas-liquid separator 6 from the inflow pipe 22. Subsequently, inside the gas-liquid separator 6, the balance of gravity and inertial force causes the refrigerant to separate into liquid-phase refrigerant ("A" in FIG. 11), gas-phase refrigerant ("B" in FIG. 11), and two-phase gas-liquid refrigerant ("C" in FIG. 11). At this point, inside the gas-liquid separator 6, the main flow pipe 20 opens at a position lower than the second branch pipe 21*b*. For this reason, the liquid-phase refrigerant produced on the floor of the gas-liquid separator 6 can be controlled to flow out selectively.

Also in Embodiment 3 above, in the case in which the upper heat source side heat exchanger 2*a* and the lower heat source side heat exchanger 2*b* operate as evaporators, by causing relatively more liquid-phase refrigerant in the gas-liquid separator 6 to flow into the upper heat source side heat exchanger 2*a* having a larger heat load, the heat exchanging performance (heat exchanging efficiency) of the upper heat source side heat exchanger 2*a* and the lower heat source side heat exchanger 2*b* can be increased, and the system performance of the air conditioning device 210 as a whole can be improved.

Embodiment 4

As described above, the second branch pipe 21*b* is only required to have the end connected somewhere between the expansion devices 15 and the connection site between the main flow pipe 20 and the first branch pipe 21*a*. For this reason, the branch circuit may also be configured as follows, for example. Note that in Embodiment 4, parts having the same configuration as any of Embodiment 1 to Embodiment 3 are denoted with the same reference signs. Also, items not described in Embodiment 4 are similar to those of any of Embodiment 1 to Embodiment 3.

Figure 12:
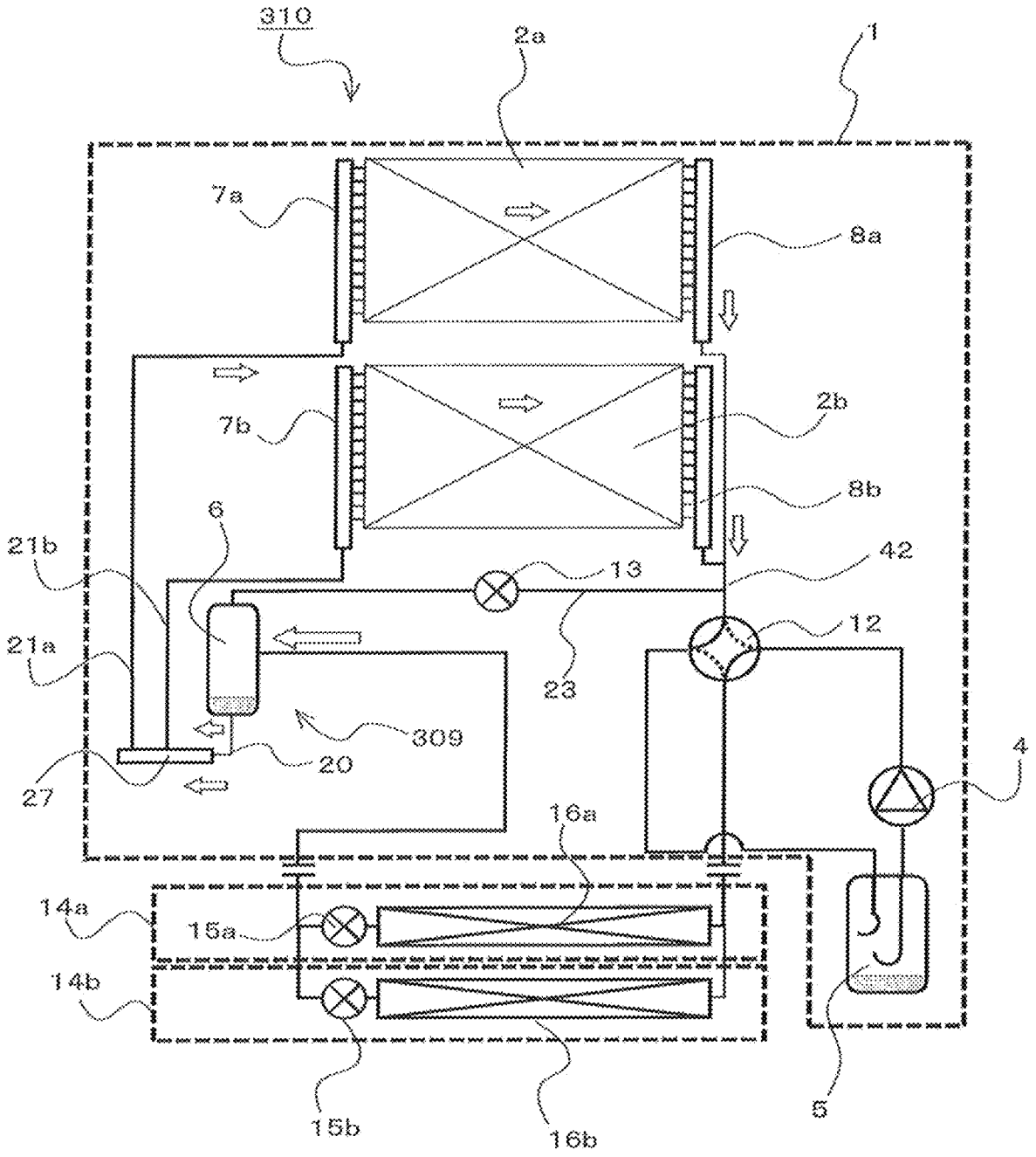
FIG. 12 is a refrigerant circuit diagram illustrating an example of an air conditioning device according to Embodiment 4 of the present invention.
Figure 13:
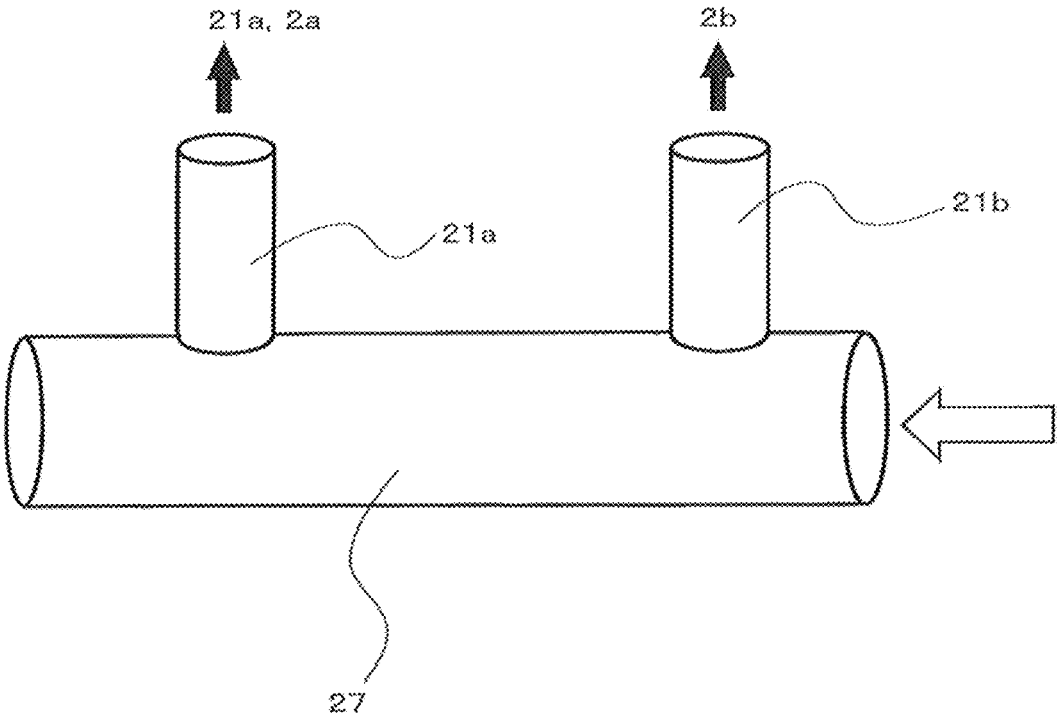
FIG. 13 is an enlarged view illustrating the principle parts in the vicinity of a horizontal pipe part of a branch circuit in the air conditioning device according to Embodiment 4 of the present invention.

FIG. 12 is a refrigerant circuit diagram illustrating an example of an air conditioning device according to Embodiment 4 of the present invention. FIG. 13 is an enlarged view illustrating the principle parts in the vicinity of a horizontal pipe part of a branch circuit in the air conditioning device. Also, FIG. 14 is an enlarged view illustrating the principle parts in the vicinity of the horizontal pipe part of the branch circuit in the air conditioning device, and illustrates a fluid state of refrigerant flowing through the horizontal pipe part.

An air conditioning device 310 according to Embodiment 4 differs from the air conditioning device 10 according to Embodiment 1 in the configuration of the branch circuit 309.

The main flow pipe 20 of the branch circuit 309 includes a horizontal pipe part 27 disposed in the horizontal direction, in which the opening on the end on the side not connected to the gas-liquid separator 6 is blocked. Additionally, the first branch pipe 21*a* connected to the upper heat source side heat exchanger 2*a* having a large heat load is connected to the horizontal pipe part 27 nearly vertically, for example. Also, the second branch pipe 21*b* connected to the lower heat source side heat exchanger 2*b* having a small heat load is connected to the horizontal pipe part 27 nearly vertically, for example, at a position farther upstream in the refrigerant flow direction during heating operation than the connection position between the horizontal pipe part 27 and the first branch pipe 21*a*.

Figure 14:
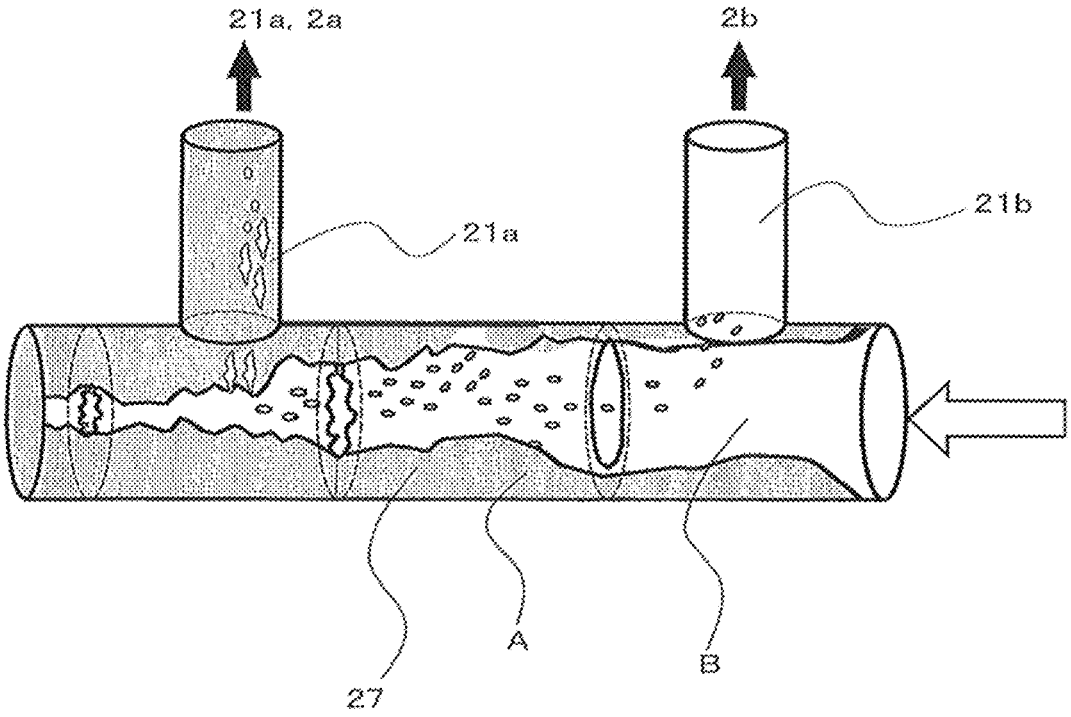
FIG. 14 is an enlarged view illustrating the principle parts in the vicinity of the horizontal pipe part of the branch circuit in the air conditioning device according to Embodiment 4 of the present invention, and illustrates a fluid state of refrigerant flowing through the horizontal pipe part.

In the case in which the upper heat source side heat exchanger 2*a* and the lower heat source side heat exchanger 2*b* operate as evaporators, refrigerant in a two-phase gas-liquid state flows into the horizontal pipe part 27 from the direction of the solid-white arrow illustrated in FIGS. 13 and 14. At this time, liquid-phase refrigerant having large inertial force exhibits a tendency to exist selectively at the terminus of the horizontal pipe part 27. Consequently, refrigerant of high quality flows into the second branch pipe 21*b* in the vicinity of the inlet of the horizontal pipe part 27, while refrigerant of low quality flows into the first branch pipe 21*a* away from the inlet of the horizontal pipe part 27.

Also in Embodiment 4 above, in the case in which the upper heat source side heat exchanger 2*a* and the lower heat source side heat exchanger 2*b* operate as evaporators, by causing relatively more liquid-phase refrigerant in the horizontal pipe part 27 to flow into the upper heat source side heat exchanger 2*a* having a larger heat load, the heat exchanging performance (heat exchanging efficiency) of the upper heat source side heat exchanger 2*a* and the lower heat source side heat exchanger 2*b* can be increased, and the system performance of the air conditioning device 310 as a whole can be improved.

Embodiment 5

The flow rate control device 13 illustrated in Embodiment 1 to Embodiment 4 is controlled as follows, for example. Note that in Embodiment 5, parts having the same configuration as any of Embodiment 1 to Embodiment 4 are denoted with the same reference signs. Also, items not described in Embodiment 5 are similar to those of any of Embodiment 1 to Embodiment 4. Also, in Embodiment 5, an example of a control method of the flow rate control device 13 is described by taking the example of the refrigerant circuit of the air conditioning device illustrated in Embodiment 1.

Figure 15:
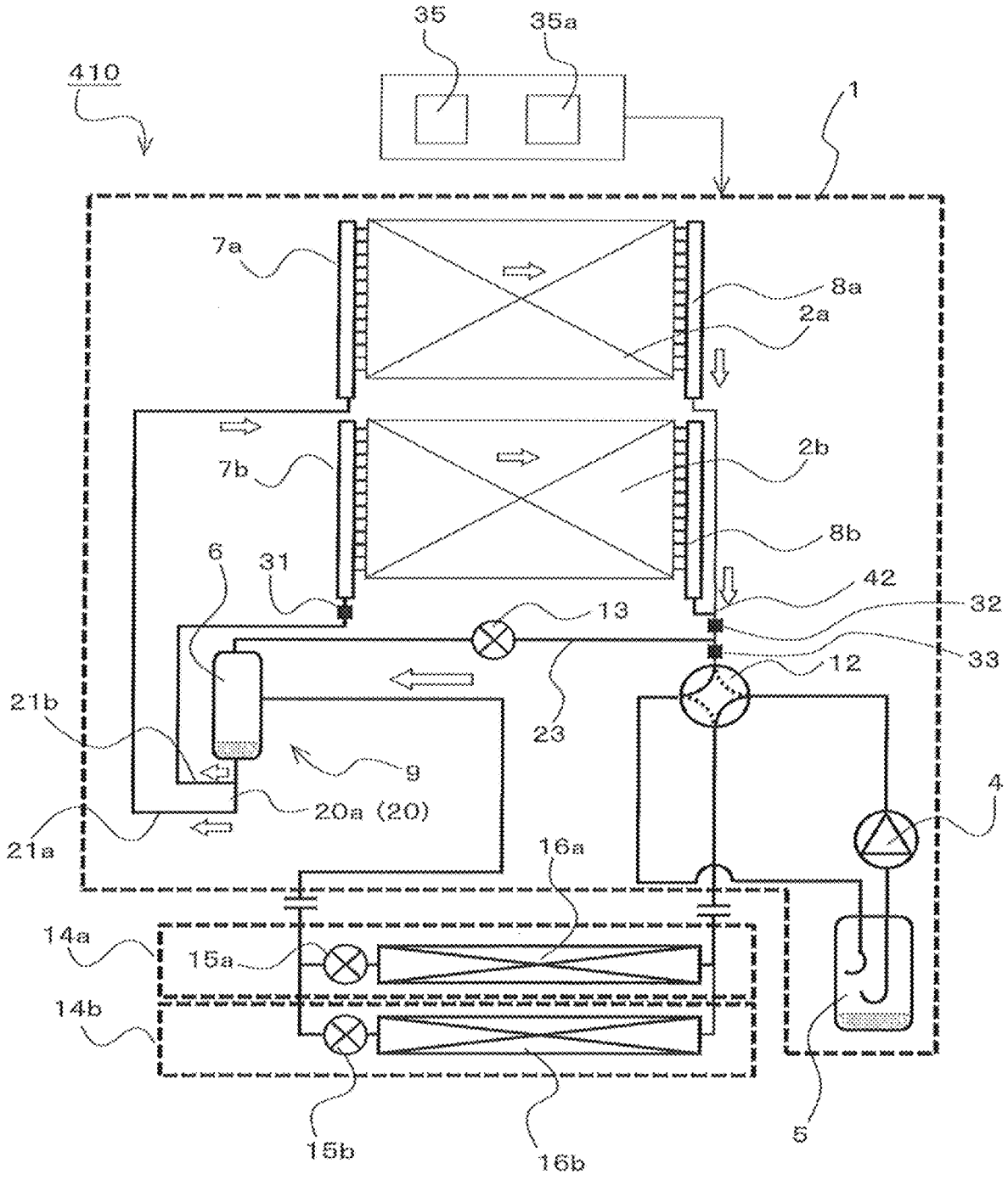
FIG. 15 is a refrigerant circuit diagram illustrating an example of an air conditioning device according to Embodiment 5 of the present invention.
Figure 16:
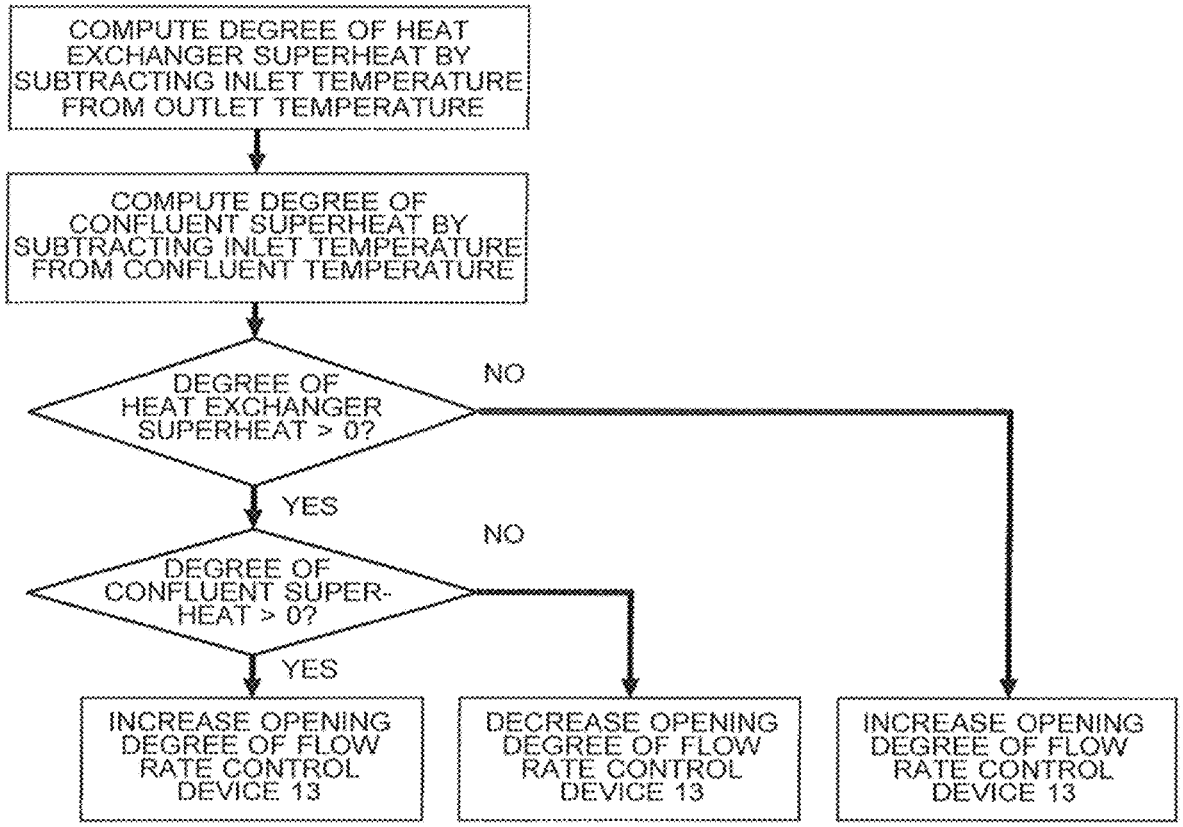
FIG. 16 is a flowchart illustrating an example of a control method of a flow rate control device of the air conditioning device according to Embodiment 5 of the present invention.

FIG. 15 is a refrigerant circuit diagram illustrating an example of an air conditioning device according to Embodiment 5 of the present invention. Also, FIG. 16 is a flowchart illustrating an example of a control method of a flow rate control device of the air conditioning device.

In the case of controlling the flow rate control device 13, for example, an inlet temperature detection device or detector 31, an outlet temperature detection device or detector 32, a confluent temperature detection device or detector 33, a flow rate control device control unit or controller 35, and a calculation unit or calculation controller 35*a* are provided in the refrigerant circuit of an air conditioning device 410.

The inlet temperature detection device 31, which is a temperature sensor, such as a thermistor, is provided on the second branch pipe 21*b*, and measures the refrigerant temperature at this position. The outlet temperature detection device 32, which is a temperature sensor, such as a thermistor, is provided to the pipe 42 that connects the heat source side heat exchangers 2 and the flow channel switch 12, and measures the refrigerant temperature at this position. More specifically, the outlet temperature detection device 32 is provided at a position farther upstream in the refrigerant flow direction during heating operation than the connection site between the pipe 42 and the gas-phase refrigerant outflow pipe 23. The confluent temperature detection device 33, which is a temperature sensor, such as a thermistor, is provided to the pipe 42 that connects the heat source side heat exchangers 2 and the flow channel switch 12, and measures the refrigerant temperature at this position. More specifically, the confluent temperature detection device 33 is provided at a position farther downstream in the refrigerant flow direction during heating operation than the connection site between the pipe 42 and the gas-phase refrigerant outflow pipe 23.

The calculation unit 35*a* is made up of a microcomputer or other components, for example, and receives output signals (detection values) from the inlet temperature detection device 31, the outlet temperature detection device 32, and the confluent temperature detection device 33. Subsequently, the calculation unit 35*a* subtracts the detection value of the inlet temperature detection device 31 from the detection value of the outlet temperature detection device 32 to compute the degree of heat exchanger superheat. Also, the calculation unit 35*a* subtracts the detection value of the inlet temperature detection device 31 from the detection value of the confluent temperature detection device 33 to compute the degree of confluent superheat. The flow rate control device control unit 35 is made up of a microcomputer or other components, for example. Additionally, the flow rate control device control unit 35 transmits a control signal to the flow rate control device 13 on the basis of the degree of heat exchanger superheat and the degree of confluent superheat computed by the calculation unit 35*a*, and controls the opening degree of the flow rate control device 13. Control of the opening degree of the flow rate control device 13 is conducted on a certain time interval, for example.

Specifically, the flow rate control device control unit 35 controls the opening degree of the flow rate control device 13 as illustrated in FIG. 16. Namely, when the degree of heat exchanger superheat is greater than 0 and the degree of confluent superheat is also greater than 0, the flow rate control device control unit 35 increases the opening degree of the flow rate control device 13. Also, when the degree of heat exchanger superheat is greater than 0 and the degree of confluent superheat is less than 0, the flow rate control device control unit 35 decreases the opening degree of the flow rate control device 13. Also, when the degree of heat exchanger superheat is less than 0, the flow rate control device control unit 35 increases the opening degree of the flow rate control device 13.

When the degree of heat exchanger superheat is greater than 0 and the degree of confluent superheat is also greater than 0, the heat source side heat exchangers 2 are in a superheated state, and also in a state in which liquid backflow in the gas-liquid separator 6 has not occurred. For this reason, by increasing the flow rate of gas-phase refrigerant flowing out from the gas-liquid separator 6 to the flow channel switch 12, further heat exchange in the heat source side heat exchangers 2 is possible. Consequently, the flow rate control device control unit 35 increases the opening degree of the flow rate control device 13, and increases the flow rate of gas-phase refrigerant flowing out from the gas-liquid separator 6 to the flow channel switch 12.

When the degree of heat exchanger superheat is greater than 0 and the degree of confluent superheat is less than 0, the heat source side heat exchangers 2 are in a superheated state, but also in a state in which liquid backflow in the gas-liquid separator 6 has occurred. In this state, liquid-phase refrigerant of a high flow rate has flowed into the gas-phase refrigerant flowing out from the gas-liquid separator 6 to the flow channel switch 12, the refrigerant of an amount present inside the refrigerant circuit has accumulated in the accumulator 5, and the heat loads of the heat source side heat exchangers 2 have decreased. To solve this problem, the flow rate control device control unit 35 decreases the opening degree of the flow rate control device 13 to decrease the flow rate of gas-phase refrigerant flowing out from the gas-liquid separator 6 to the flow channel switch 12, prevent liquid backflow in the gas-liquid separator 6, and resolve the accumulation of refrigerant in the accumulator 5. With this operation, the superheated state in the heat source side heat exchangers 2 is resolved.

When the degree of heat exchanger superheat is less than 0, the flow rate of refrigerant circulating through the refrigerant circuit is excessive, and in addition, the superheated state of the heat source side heat exchangers 2 cannot be estimated from the temperatures. For this reason, the flow rate control device control unit 35 increases the opening degree of the flow rate control device 13. Consequently, the flow rate of refrigerant circulating through the refrigerant circuit decreases, and the outlets of the heat source side heat exchangers 2 enter a superheated state.

According to Embodiment 5 above, an appropriate flow rate of refrigerant can be made to circulate through the refrigerant circuit, and thus the heat exchanging performance (heat exchanging efficiency) of the upper heat source side heat exchanger 2*a* and the lower heat source side heat exchanger 2*b* can be increased further, and the system performance of the air conditioning device 410 as a whole can be improved further.

Embodiment 6

A flow rate control device 30 that adjusts the flow rate of refrigerant flowing through the second branch pipe 21*b* may also be provided in the second branch pipe 21*b* of the refrigerant circuit of the air conditioning device illustrated in Embodiment 1 to Embodiment 5. Note that in Embodiment 6, parts having the same configuration as any of Embodiment 1 to Embodiment 5 are denoted with the same reference signs. Also, items not described in Embodiment 6 are similar to those of any of Embodiment 1 to Embodiment 5. Also, in Embodiment 6, an example of providing the flow rate control device 30 in the air conditioning device illustrated in Embodiment 5 is described.

Figure 17:
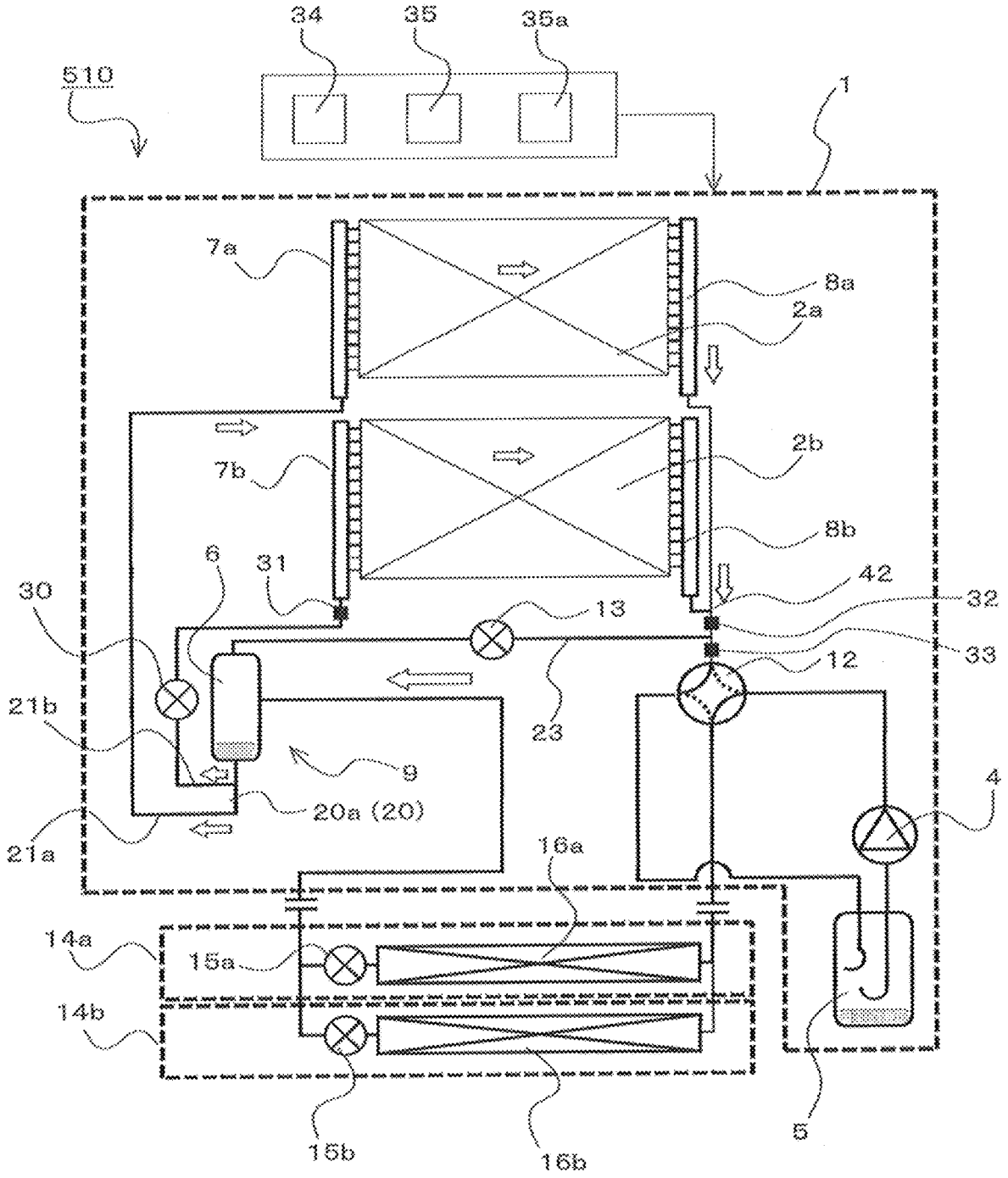
FIG. 17 is a refrigerant circuit diagram illustrating an example of an air conditioning device according to Embodiment 6 of the present invention.

FIG. 17 is a refrigerant circuit diagram illustrating an example of an air conditioning device according to Embodiment 6 of the present invention.

An air conditioning device 510 according to Embodiment 6 is provided with a flow rate control device 30 and a second flow rate control device control unit 34, in addition to the configuration of the air conditioning device 410 illustrated in Embodiment 5. The flow rate control device 30 adjusts the flow rate of refrigerant flowing through the second branch pipe 21*b*, or in other words, the flow rate of refrigerant flowing into the lower heat source side heat exchanger 2*b*. In the case in which the inlet temperature detection device 31 is provided to the second branch pipe 21*b*, to enable the inlet temperature detection device 31 to measure the temperature of refrigerant flowing into the lower heat source side heat exchanger 2*b* during heating operation, the flow rate control device 30 is provided farther upstream in the refrigerant flow direction during heating operation than the inlet temperature detection device 31. The flow rate control device 30 is an expansion device, typically a linear electronic expansion valve (LEV), for example. The second flow rate control device control unit 34 is made up of a microcomputer or other components, for example, and transmits a control signal to the flow rate control device 30 to control the opening degree of the flow rate control device 30.

According to Embodiment 6 above, it is possible to adjust the flow rate of refrigerant flowing into the upper heat source side heat exchanger 2*a* and the lower heat source side heat exchanger 2*b*, in addition to the gas-liquid mixture ratio of refrigerant flowing into the upper heat source side heat exchanger 2*a* and the lower heat source side heat exchanger 2*b*. For this reason, the heat exchanging performance (heat exchanging efficiency) of the upper heat source side heat exchanger 2*a* and the lower heat source side heat exchanger 2*b* can be increased further, and the system performance of the air conditioning device 510 as a whole can be improved further.

Embodiment 7

The number of heat source side heat exchangers that can be connected in parallel to a branch circuit of the present invention are not limited to two. Hereinafter, an example of connecting four heat source side heat exchangers in parallel to a branch circuit will be described. Note that in Embodiment 7, parts having the same configuration as any of Embodiment 1 to Embodiment 6 are denoted with the same reference signs. Also, items not described in Embodiment 7 are similar to those of any of Embodiment 1 to Embodiment 6. Also, in Embodiment 7, an example of using the branch circuit illustrated in Embodiment 4 is described.

Figure 18:
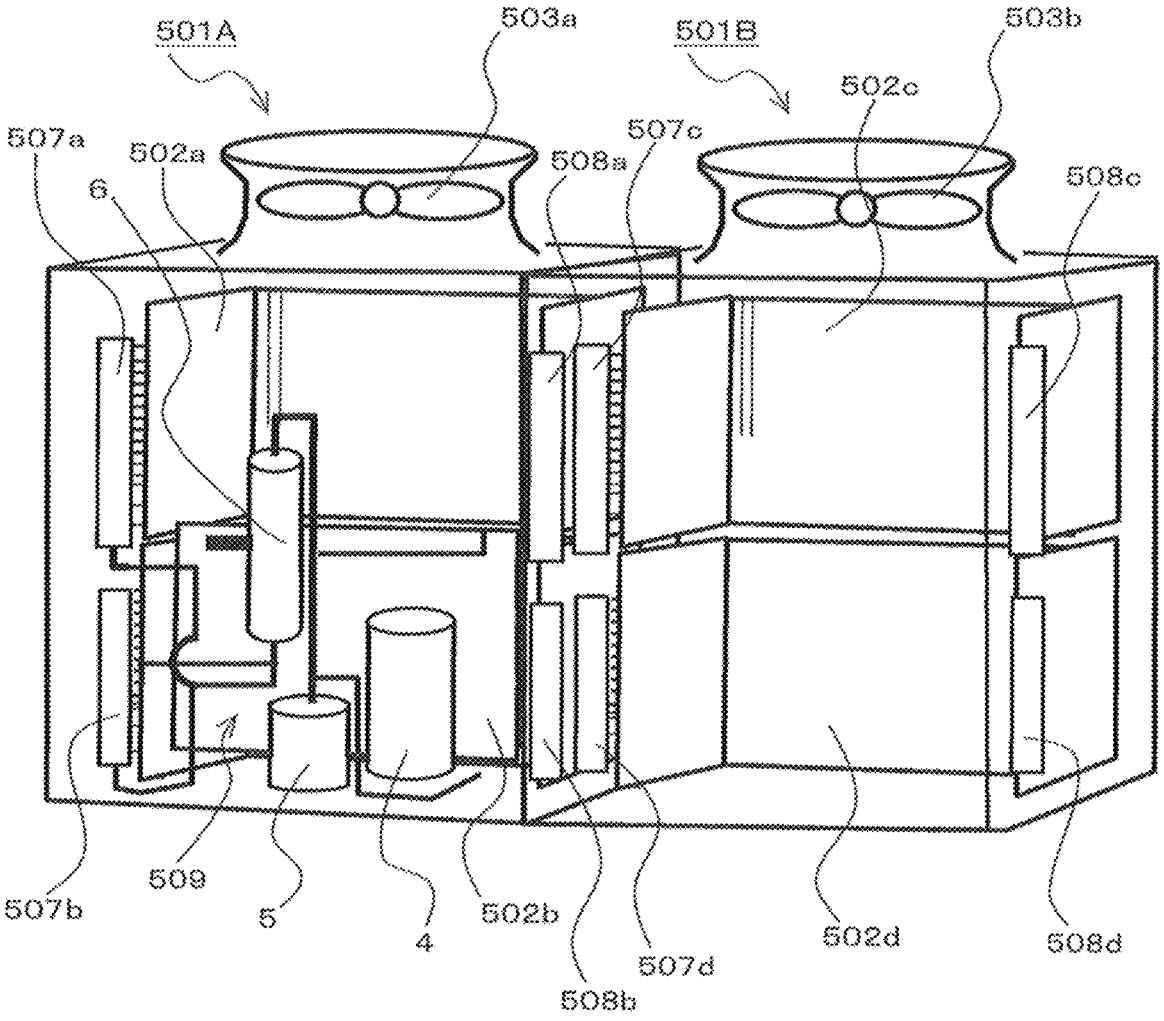
FIG. 18 is a perspective view of the interior of heat source side units of an air conditioning device according to Embodiment 7 of the present invention.
Figure 19:
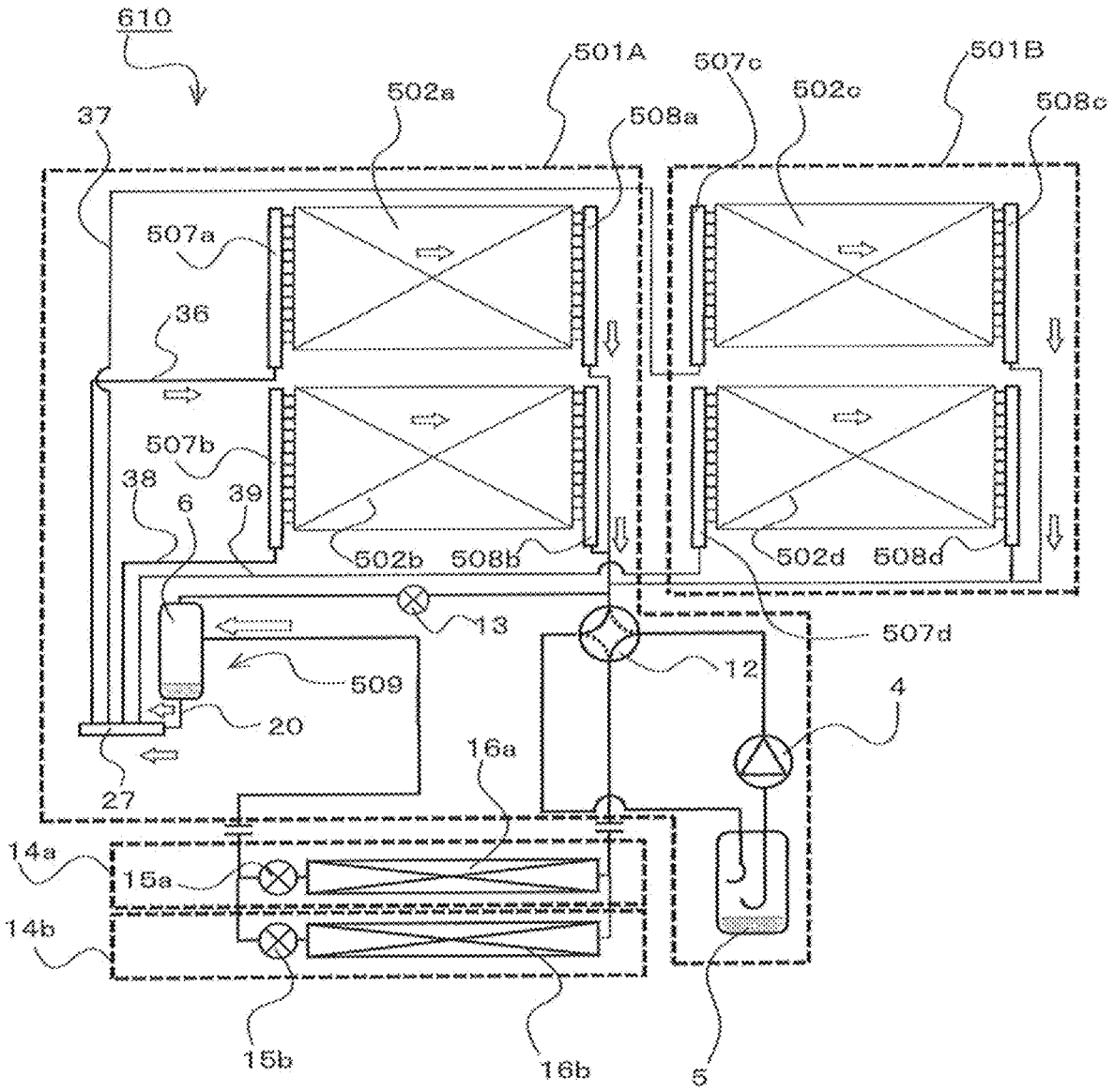
FIG. 19 is a refrigerant circuit diagram illustrating an example of the air conditioning device according to Embodiment 7 of the present invention.
Figure 20:
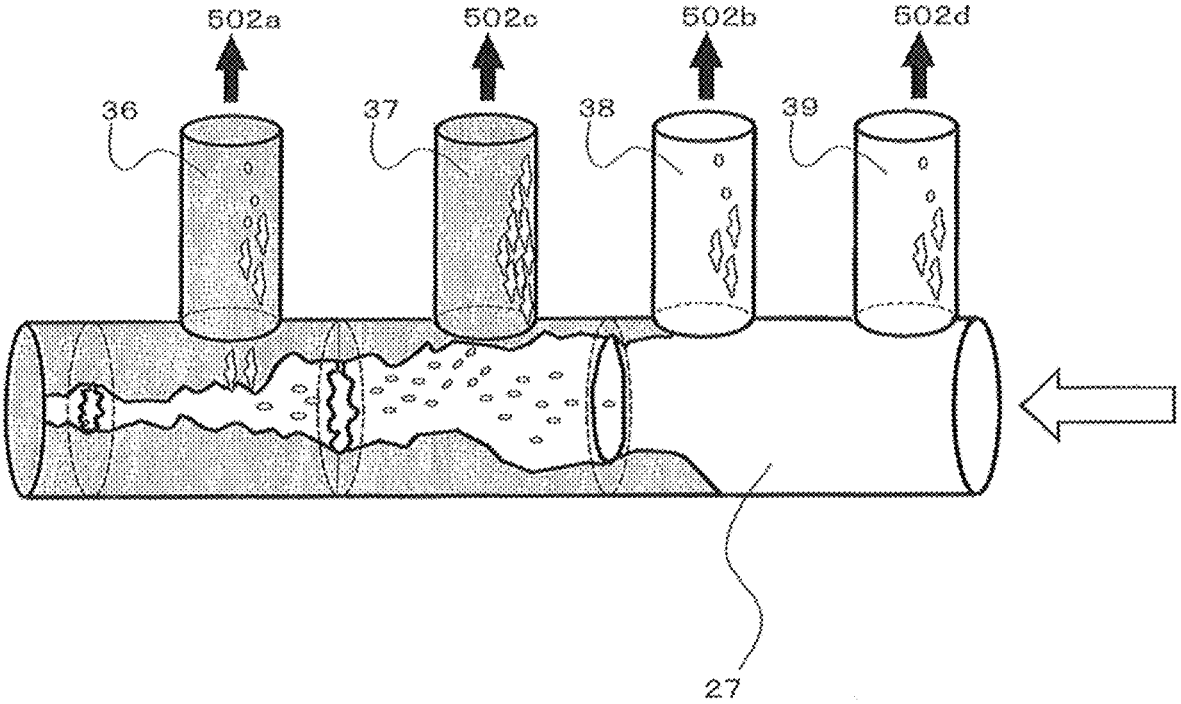
FIG. 20 is an enlarged view illustrating the principle parts in the vicinity of a horizontal pipe part of a branch circuit in the air conditioning device according to Embodiment 7 of the present invention, and illustrates a fluid state of refrigerant flowing through the horizontal pipe part.

FIG. 18 is a perspective view of the interior of heat source side units of an air conditioning device according to Embodiment 7 of the present invention. FIG. 19 is a refrigerant circuit diagram illustrating an example of the air conditioning device according to Embodiment 7 of the present invention. Also, FIG. 20 is an enlarged view illustrating the principle parts in the vicinity of a horizontal pipe part of a branch circuit in the air conditioning device according to Embodiment 7 of the present invention, and illustrates a fluid state of refrigerant flowing through the horizontal pipe part.

An air conditioning device 610 according to Embodiment 7 is provided with four heat source side heat exchangers. In addition, the air conditioning device 610 is provided with two heat source side units (a first heat source side unit 501A and a second heat source side unit 501B). The first heat source side unit 501A and the second heat source side unit 501B each house two heat source side heat exchangers.

The housing of the first heat source side unit 501A has the same shape as the housing 11 illustrated in Embodiment 1, and a first fan 503*a* is provided in an air outlet formed in the top face. Also, in the housing of the first heat source side unit 501A, the two heat source side heat exchangers are arranged in the vertical direction. These heat source side heat exchangers have the same shape as the heat source side heat exchangers 2 illustrated in Embodiment 1. In Embodiment 7, the heat source side heat exchanger disposed on the upper side is referred to as the first upper heat source side heat exchanger 502*a*, while the heat source side heat exchanger disposed on the lower side is referred to as the first lower heat source side heat exchanger 502*b*. The first upper heat source side heat exchanger 502*a* is provided with a first upper distributor 507*a* with the same configuration as the distributors 7 illustrated in Embodiment 1, and a first upper confluent pipe 508*a* with the same configuration as the confluent pipes 8 illustrated in Embodiment 1. A branch pipe 36 is connected to the first upper distributor 507*a*. Also, the first lower heat source side heat exchanger 502*b* is provided with a first lower distributor 507*b* with the same configuration as the distributors 7 illustrated in Embodiment 1, and a first lower confluent pipe 508*b* with the same configuration as the confluent pipes 8 illustrated in Embodiment 1. A branch pipe 38 is connected to the first lower distributor 507*b*. In other words, the first upper heat source side heat exchanger 502*a* is configured to have the heat load greater than the heat load on the first lower heat source side heat exchanger 502*b*.

Similarly, the housing of the second heat source side unit 501B has the same shape as the housing 11 illustrated in Embodiment 1, and a second fan 503*b* is provided in an air outlet formed in the top face. Also, in the housing of the second heat source side unit 501B, the two heat source side heat exchangers are arranged in the vertical direction. These heat source side heat exchangers have the same shape as the heat source side heat exchangers 2 illustrated in Embodiment 1. In Embodiment 7, the heat source side heat exchanger disposed on the upper side is referred to as the second upper heat source side heat exchanger 502*c*, while the heat source side heat exchanger disposed on the lower side is referred to as the second lower heat source side heat exchanger 502*d*. The second upper heat source side heat exchanger 502*c* is provided with a second upper distributor 507*c* with the same configuration as the distributors 7 illustrated in Embodiment 1, and a second upper confluent pipe 508*c* with the same configuration as the confluent pipes 8 illustrated in Embodiment 1. A branch pipe 37 is connected to the second upper distributor 507*c*. Also, the second lower heat source side heat exchanger 502*d* is provided with a second lower distributor 507*d* with the same configuration as the distributors 7 illustrated in Embodiment 1, and a second lower confluent pipe 508*d* with the same configuration as the confluent pipes 8 illustrated in Embodiment 1. A branch pipe 39 is connected to the second lower distributor 507*d*. In other words, the second upper heat source side heat exchanger 502*c* is configured to have the heat load greater than the heat load on the second lower heat source side heat exchanger 502*d*.

Also, in Embodiment 7, the first upper heat source side heat exchanger 502*a* is configured to have the heat load greater than the heat load on the second upper heat source side heat exchanger 502*c*, the second upper heat source side heat exchanger 502*c* is configured to have the heat load greater than the heat load on the first lower heat source side heat exchanger 502*b*, and the first lower heat source side heat exchanger 502*b* is configured to have the heat lead greater than the heat load on the second lower heat source side heat exchanger 502*d*. In other words, the magnitudes of the heat loads are such that the first upper heat source side heat exchanger 502*a*>the second upper heat source side heat exchanger 502*c*>the first lower heat source side heat exchanger 502*b*>the second lower heat source side heat exchanger 502*d*.

As illustrated in FIG. 20, in the case in which the first upper heat source side heat exchanger 502*a*, the first lower heat source side heat exchanger 502*b*, the second upper heat source side heat exchanger 502*c*, and the second lower heat source side heat exchanger 502*d* operate as evaporators, refrigerant in a two-phase gas-liquid state flows into the horizontal pipe part 27 of a branch circuit 509 from the direction of the solid-white arrow. At this time, liquid-phase refrigerant having large inertial force exhibits a tendency to exist selectively at the terminus of the horizontal pipe part 27. Consequently, the branch pipes connected to the heat source side heat exchangers with larger heat loads are connected nearly perpendicular, for example, in order from the terminus of the horizontal pipe part 27 and proceeding towards the inlet side. Specifically, starting from the terminus of the horizontal pipe part 27 and proceeding towards the inlet side, the branch pipe 36 connected to the first upper heat source side heat exchanger 502*a*, the branch pipe 37 connected to the second upper heat source side heat exchanger 502*c*, the branch pipe 38 connected to the first lower heat source side heat exchanger 502*b*, and the branch pipe 39 connected to the second lower heat source side heat exchanger 502*d* are connected in order. With this configuration, two-phase gas-liquid refrigerant of lower quality flows into the branch pipe connected at a position closer to the terminus of the horizontal pipe part 27. In other words, two-phase gas-liquid refrigerant of lower quality flows into the heat source side heat exchanger with a greater heat load.

According to Embodiment 7 above, in the case in which the first upper heat source side heat exchanger 502*a*, the first lower heat source side heat exchanger 502*b*, the second upper heat source side heat exchanger 502*c*, and the second lower heat source side heat exchanger 502*d* operate as evaporators, in the horizontal pipe part 27, two-phase gas-liquid refrigerant of lower quality flows into the heat source side heat exchanger with a greater heat load, and thus the heat exchanging performance (heat exchanging efficiency) of the first upper heat source side heat exchanger 502*a*, the first lower heat source side heat exchanger 502*b*, the second upper heat source side heat exchanger 502*c*, and the second lower heat source side heat exchanger 502*d* can be increased, and the system performance of the air conditioning device 610 as a whole can be improved.

Embodiment 8

Embodiment 1 to Embodiment 7 above envision an air conditioning device provided with a heat source side unit in which a fan is disposed in the top face of the housing. However, the present invention is not limited to the configuration, and the present invention can also be implemented in an air conditioning device provided with a heat source side unit having some other configuration. Hereinafter, an example of such an air conditioning device will be described. Note that in Embodiment 8, parts having the same configuration as any of Embodiment 1 to Embodiment 7 are denoted with the same reference signs. Also, items not described in Embodiment 8 are similar to those of any of Embodiment 1 to Embodiment 7.

Figure 21:
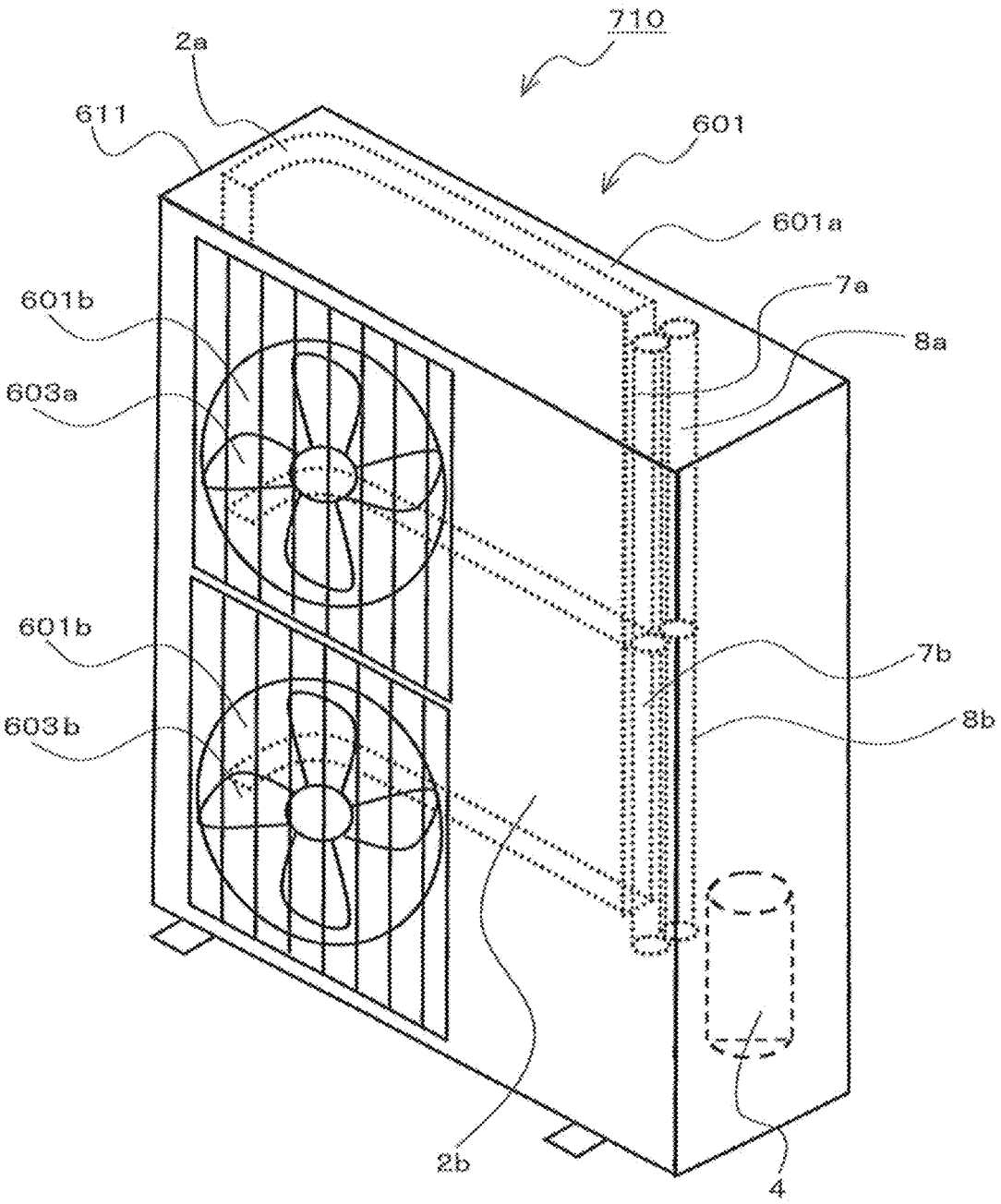
FIG. 21 is a perspective view illustrating a heat source side unit of an air conditioning device according to Embodiment 8 of the present invention.

FIG. 21 is a perspective view illustrating a heat source side unit of an air conditioning device according to Embodiment 8 of the present invention. Note that the refrigerant circuit of an air conditioning device 710 according to Embodiment 8 is similar to that of any of Embodiment 1 to Embodiment 7.

A heat source side unit 601 of the air conditioning device 710 according to Embodiment 8 is provided with a housing 611 in which an air inlet 601*a* and air outlets 601*b* are formed in a side face part. Inside the housing 611, the upper heat source side heat exchanger 2*a* and the lower heat source side heat exchanger 2*b* are arranged in the vertical direction, facing the air inlet 601*a*. Note that these heat source side heat exchangers may also be arranged in the horizontal direction.

In addition, inside the housing 611, a first fan 603*a* and a second fan 603*b* are each provided to a corresponding one of the air outlets 601*b*. Additionally, the first fan 603*a* is disposed to face the upper heat source side heat exchanger 2*a*. Meanwhile, the second fan 603*b* is disposed to face the lower heat source side heat exchanger 2*b*. In other words, refrigerant flowing through the upper heat source side heat exchanger 2*a* exchanges heat with air supplied by the first fan 603*a*, while refrigerant flowing through the lower heat source side heat exchanger 2*b* exchanges heat with air supplied by the second fan 603*b*.

In the air conditioning device 710 configured as described above, in the case in which the flow rate of circulating refrigerant becomes low, such as during low-performance operation, it is favorable to supply more liquid-phase refrigerant to one of the heat source side heat exchangers, and increase the rotation frequency of the fan corresponding to that heat source side heat exchanger over the other. This operation is to make uniform the distribution of refrigerant to each of the heat transfer pipes of the heat source side heat exchangers. At this time, the rotation frequency of the other fan, or in other words the power consumption, can be lowered, thus leading to power savings overall.

Herein, as described above, the refrigerant circuit of the air conditioning device 710 according to Embodiment 8 (the refrigerant circuit illustrated in any of Embodiment 1 to Embodiment 7) is able to supply the upper heat source side heat exchanger 2*a* with refrigerant of lower quality than the refrigerant supplied to the lower heat source side heat exchanger 2*b*. In other words, more liquid-phase refrigerant can be supplied to the upper heat source side heat exchanger 2*a* than to the lower heat source side heat exchanger 2*b*. For this reason, in the case in which the flow rate of circulating refrigerant becomes low, such as during low-performance operation, the air conditioning device 710 according to Embodiment 8 is able to achieve power savings in the air conditioning device 710 by increasing the rotation frequency of the first fan 603*a* that supplies air to the upper heat source side heat exchanger 2*a*, while lowering the rotation frequency of the second fan 603*b*.

REFERENCE SIGNS LIST

1, 601 heat source side unit 501A first heat source side unit 501B second heat source side unit 1*a*, 601*a* air inlet 1*b*, 601*b* air outlet 2, 102 heat source side heat exchanger 2*a*, 102*a* upper heat source side heat exchanger 2*b*, 102*b* lower heat source side heat exchanger 502*a* first upper heat source side heat exchanger 502*b* first lower heat source side heat exchanger 502*c* second upper heat source side heat exchanger 502*d* second lower heat source side heat exchanger 3 fan 503*a*, 603*a* first fan 503*b*, 603*b* second fan 4 compressor 5 accumulator 6 gas-liquid separator 7, 107 distributor 7*a*, 107*a* upper distributor 7*b*, 107*b* lower distributor 507*a* first upper distributor 507*b* first lower distributor 507*c* second upper distributor 507*d* second lower distributor 8 confluent pipe 8*a* upper confluent pipe 8*b* lower confluent pipe 508*a* first upper confluent pipe 508*b* first lower confluent pipe 508*c* second upper confluent pipe 508*d* second lower confluent pipe 9, 109, 209, 309, 509 branch circuit 10, 110, 210, 310, 410, 510, 610, 710 air conditioning device 11, 611 housing 12 flow channel switch 13 flow rate control device 14 use side unit 14*a* first use side unit 14*b* second use side unit 15 expansion device 15*a* first expansion device 15*b* second expansion device 16 use side heat exchanger 16*a* first use side heat exchanger 16*b* second use side heat exchanger 20 main flow pipe 20*a* vertical pipe part 21*a* first branch pipe 21*b* second branch pipe 22 inflow pipe 23 gas-phase refrigerant outflow pipe horizontal pipe part 30 flow rate control device 31 inlet temperature detection device 32 outlet temperature detection device 33 confluent temperature detection device 34 flow rate control device control unit 35 flow rate control device control unit 35*a* calculation unit 36 branch pipe 37 branch pipe 38 branch pipe 39 branch pipe 40 heat transfer pipe 41 heat transfer fin 42 pipe

The invention claimed is:

1. A refrigerant circuit, comprising:

a compressor;

a condenser;

an expansion device;

a plurality of evaporators having different heat loads, the plurality of evaporators being housed in a same housing, the plurality of evaporators being connected in parallel between the expansion device and a suction side of the compressor, the plurality of evaporators comprising a first evaporator and a second evaporator having a smaller heat load than the first evaporator;

a fan in an air outlet in a top face of the housing; and a branch circuit provided between the expansion device and the plurality of evaporators, and configured to flow refrigerant from the expansion device to each of the plurality of evaporators and distribute refrigerant to each of the plurality of evaporators, a gas-phase refrigerant outflow pipe having one end connected to the gas-liquid separator and an other end connected to a suction pipe connecting the plurality of evaporators and the suction side of the compressor, the gas-phase refrigerant outflow pipe causing gas-phase refrigerant separated by the gas-liquid separator to flow out from the gas-liquid separator;

a flow rate control device provided in the gas-phase refrigerant outflow pipe, and configured to adjust a flow rate of the gas-phase refrigerant from the gas-liquid separator;

an inlet temperature detector provided to the second branch pipe;

an outlet temperature detector provided to the suction pipe at a position farther upstream in a refrigerant flow direction than a connection site between the suction pipe and the gas-phase refrigerant outflow pipe;

a confluent temperature detector provided to the suction pipe at a position farther downstream in the refrigerant flow direction than the connection site between the suction pipe and the gas-phase refrigerant outflow pipe;

a flow rate control device controller configured to control an opening degree of the flow rate control device; and a calculation controller configured to compute a degree of heat exchanger superheat and a degree of confluent superheat, the degree of heat exchanger superheat being a value obtained by subtracting a detection value of the inlet temperature detector from a detection value of the outlet temperature detector, and the degree of confluent superheat being a value obtained by subtracting a detection value of the inlet temperature detector from a detection value of the confluent temperature detector, wherein the branch circuit is configured to supply the first evaporator with refrigerant of lower quality than quality of refrigerant supplied to the second evaporator, wherein the branch circuit includes a gas-liquid separator provided downstream of the expansion device and provided between the expansion device and the plurality of evaporators, a main flow pipe having one end connected to the gas-liquid separator, and configured to supply liquid-phase refrigerant or two-phase gas-liquid refrigerant downstream, a first branch pipe having one end connected to the main flow pipe, and an other end connected to the first evaporator, and a second branch pipe having one end connected to the main flow pipe between the gas-liquid separator and a connection site between the main flow pipe and the first branch pipe, and an other end connected to the second evaporator, and wherein the plurality of evaporators are arranged to face an air inlet formed in a side face of the housing, wherein the first evaporator is disposed above the second evaporator, and wherein the flow rate control device controller is configured to increase the opening degree of the flow rate control device when the degree of heat exchanger superheat is greater than 0 and the degree of confluent superheat is greater than 0, decrease the opening degree of the flow rate control device when the degree of heat exchanger superheat is greater than 0 and the degree of confluent superheat is less than 0, and increase the opening degree of the flow rate control device when the degree of heat exchanger superheat is less than 0.

2. The refrigerant circuit of claim 1, wherein the main flow pipe includes a vertical pipe part disposed in a vertical direction, the one end of the first branch pipe is connected to the vertical pipe part, and the one end of the second branch pipe is connected to the vertical pipe part at a position farther upstream in the refrigerant flow direction than a connection position between the vertical pipe part and the first branch pipe.

3. The refrigerant circuit of claim 2, wherein the one end of the second branch pipe projects into an inside of the vertical pipe part.

4. The refrigerant circuit of claim 1, wherein the main flow pipe includes a horizontal pipe part disposed in a horizontal direction, the horizontal pipe part being blocked on an end on a side not connected to the gas-liquid separator, the one end of the first branch pipe is connected to the horizontal pipe part, and the one end of the second branch pipe is connected to the horizontal pipe part at a position farther upstream in the refrigerant flow direction than a connection position between the horizontal pipe part and the first branch pipe.

5. The refrigerant circuit of claim 1, further comprising a flow rate control device provided in the second branch pipe, and configured to adjust a flow rate of refrigerant flowing through the second branch pipe.

6. The refrigerant circuit of claim 1, wherein the plurality of evaporators each include a plurality of heat transfer pipes arranged in a horizontal direction, and a distributor connected to the branch circuit, and configured to distribute refrigerant flowing from the branch circuit into the plurality of heat transfer pipes.

7. The refrigerant circuit of claim 1, wherein the main flow pipe includes a first portion and a second portion, a quality of refrigerant which flows through the first portion being lower than quality of refrigerant which flows through the second portion, the first branch pipe is connected to the main flow pipe at the first portion, the second branch pipe is connected to the main flow pipe at the second portion, and the first branch pipe is configured to supply the first evaporator with refrigerant of lower quality than a quality of refrigerant supplied from the second branch pipe to the second evaporator.

8. The refrigerant circuit of claim 1, wherein:

the expansion device includes an expansion valve.

9. The refrigerant circuit of claim 1, wherein:

the expansion device includes an electronic expansion valve.

10. The refrigerant circuit of claim 1, wherein:

the first evaporator includes a first header distributor, a plurality of first heat transfer pipes connected to the first header distributor, and a plurality of first heat transfer fins into which the plurality of first heat transfer pipes are inserted, the second evaporator includes a second header distributor, a plurality of second heat transfer pipes connected to the second header distributor, and a plurality of second heat transfer fins into which the plurality of second heat transfer pipes are inserted, the other end of the first branch pipe is connected to the first header distributor, and the other end of the second branch pipe is connected to the second header distributor.

11. The refrigerant circuit of claim 1, wherein:

the plurality of evaporators exchange heat between refrigerant and outdoor air, the air inlet formed in the side face of the housing is an outdoor air inlet, and the compressor, the plurality of evaporators, and the branch circuit including the gas-liquid separator are housed in the same housing.

* * * * *